US007004556B2

(12) United States Patent
Cleland et al.

(10) Patent No.: US 7,004,556 B2
(45) Date of Patent: Feb. 28, 2006

(54) HIGH PRINT QUALITY INKJET PRINTHEAD

(75) Inventors: Todd A. Cleland, Corvallis, OR (US); Robert C. Maze, Corvallis, OR (US); Michael D. Miller, Shedd, OR (US); Rama Prasad, Albany, OR (US); Robert N. K. Browning, Corvallis, OR (US); Dale R. Oughton, Albany, OR (US); Joseph M. Torgerson, Philomath, OR (US); Kenneth D. Saul, Philomath, OR (US); Michael B. Hager, Corvallis, OR (US); Douglas M. Collins, Corvallis, OR (US); Leslie A. Field, Portola Valley, CA (US); Storrs Hoen, Brisbane, CA (US); Phillip W. Barth, Portola Valley, CA (US)

(73) Assignee: Hewlett-Packard Development, L.P., Houston, TX (US)

( * ) Notice: Subject to any disclaimer, the term of this patent is extended or adjusted under 35 U.S.C. 154(b) by 0 days.

(21) Appl. No.: 10/952,155

(22) Filed: Sep. 28, 2004

(65) Prior Publication Data

US 2005/0104934 A1 May 19, 2005

Related U.S. Application Data

(63) Continuation of application No. 10/266,163, filed on Oct. 7, 2002, now Pat. No. 6,799,822, which is a continuation of application No. 09/386,015, filed on Aug. 30, 1999, now Pat. No. 6,491,377.

(51) Int. Cl.
*B41J 29/38* (2006.01)
*B41J 2/05* (2006.01)

(52) U.S. Cl. ..... 347/12; 347/58

(58) Field of Classification Search ..... 347/12, 347/13, 50, 54, 61–65, 67, 180–182, 56–59; 257/690, 691; 439/386
See application file for complete search history.

(56) References Cited

U.S. PATENT DOCUMENTS 5,030,971 A * 7/1991 Drake et al. ..... 347/57
5,638,101 A * 6/1997 Keefe et al. ..... 347/65
6,234,598 B1 * 5/2001 Torgerson et al. ..... 347/13

* cited by examiner

*Primary Examiner*—Juanita D Stephens

(57) ABSTRACT

Several improvements have been made in inkjet print cartridges to realize 5 ng drop weights at ejection frequencies of 18 KHz. These improvements include small nozzle openings, improved heater resistor efficiency, and better ink supply reliability.

37 Claims, 19 Drawing Sheets

HIGH PRINT QUALITY INKJET PRINTHEAD

CROSS-REFERENCE TO RELATED APPLICATIONS

This is a continuation of U.S. Ser. No. 10/266,163 filed on Oct. 7, 2002, now U.S. Pat. No. 6,799,822, issued Oct. 5, 2004, which is a continuation of U.S. Ser. No. 09/386,015 filed on Aug. 30, 1999, now U.S. Pat. No. 6,491,377, issued Dec. 10, 2002, both of which are hereby incorporated by reference herein.

BACKGROUND OF THE INVENTION

The present invention relates generally to inkjet printing devices, and more particularly to a print cartridge providing high quality print output and adapted for use in inkjet printing devices. The present disclosure may contain material related to the inventions disclosed in U.S. patent application Ser. No. 09/386,573, "Segmented Resistor Drop Generator For InkJet Printing", U.S. Patent Application Ser. No. 09/386,548, "Redundant Input Signal Paths For An InkJet Print Head", U.S. Patent Application Ser. No. 09/385,810, "InkJet Printhead With Flow Control Manifold And Columnar Structures", U.S. Patent Application Ser. No. 09/386,580, "Asymmetric Ink Emitting Orifices For Improved Inkjet Drop Formation", U.S. Patent Application Ser. No. 09/386,028, "High Drop Generator Density PrintHead", U.S. Patent Application Ser. No. 09/386,574, "Shared Multiple Terminal Ground Returns For An Inkjet Printhead", U.S. Patent Application Ser. No. 09/385,297, "High Thermal Efficiency InkJet Printhead", and U.S. Patent Application Ser. No. 09/385,300, "Ink Jet Drop Generator And Ink Composition Printing System For Producing Low Ink Drop Weight With High Frequency Operation", filed on even date herewith and assigned to the assignee of the present invention.

The art of inkjet printing technology is relatively well developed. However, users of inkjet printing products expect a perfect or near-perfect rendition of characters and images, in both black and color, as a hard copy output from their printing device. Commercial products such as computer printers, graphics plotters, copiers, and facsimile machines successfully employ inkjet technology for producing the hard copy printed output. The basics of the technology has been disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Inkjet devices have also been described by W. J. Lloyd and H. T. Taub in Output Hardcopy Devices (R. C. Durbeck and S. Sherr, ed., Academic Press, San Diego, 1988, chapter 13). The technology for improved print quality often is realized in the mechanism—the print cartridge—that delivers ink to the medium to be printed upon.

A thermal inkjet printer for inkjet printing typically includes one or more translationally reciprocating print cartridges in which small drops of ink are ejected by a drop generator towards a medium upon which it is desired to place alphanumeric characters, graphics, or images. Such cartridges typically include a printhead having an orifice member or plate that has a plurality of small nozzles through which the ink drops are ejected. Beneath the nozzles are ink firing chambers, enclosures in which ink resides prior to ejection by an ink ejector through a nozzle. Ink is supplied to the ink firing chambers through ink channels that are in fluid communication with an ink reservoir, which may be contained in a reservoir portion of the print cartridge or in a separate ink container spaced apart from the printhead.

Ejection of an ink drop through a nozzle employed in a thermal inkjet printer is accomplished by quickly heating the volume of ink residing within the ink firing chamber with a selectively energizing electrical pulse to a heater resistor ink ejector positioned in the ink firing chamber. At the commencement of the heat energy output from the heater resistor, an ink vapor bubble nucleates at sites on the surface of the heater resistor or its protective layers. The rapid expansion of the ink vapor bubble forces the liquid ink through the nozzle. Once the electrical pulse ends and an ink drop is ejected, the ink firing chamber refills with ink from the ink channel and ink reservoir.

The minimum electrical energy required to eject an ink drop of a reliable volume is referred to as "turn-on energy". The turn-on energy is a sufficient amount of energy to overcome thermal and mechanical inefficiencies of the ejection process and to form a vapor bubble having sufficient size to eject an amount of ink (generally determined by the design parameters of the firing chamber) from the printhead nozzle. Conventional thermal inkjet printheads operate at a firing energy slightly greater than the turn-on energy to assure that drops of an uniform size are ejected. Adding substantially more energy than the turn-on energy generally does not increase drop size but does deposit excess heat in the printhead.

Following removal of electrical power from the heater resistor, the vapor bubble collapses in the firing chamber in a small but violent way. Components within the printhead in the vicinity of the vapor bubble collapse are susceptible to fluid mechanical stresses (cavitation) as the vapor bubble collapses, thereby allowing ink to crash into the ink firing chamber components. The heater resistor is particularly susceptible to damage from cavitation. One or more protective layers are typically disposed over the resistor and adjacent structures to protect the resistor from cavitation and from chemical attack by the ink. One protective layer in contact with the ink is a mechanically hard cavitation layer that provides protection from the cavitation wear of the collapsing ink. Another layer, a passivation layer, is typically placed between the cavitation layer and the heater resistor and its associated structures to provide protection from chemical attack. Thermal inkjet ink is chemically reactive, and prolonged exposure of the heater resistor and its electrical interconnections to the ink will result in a degradation and failure of the heater resistor and electrical conductors. The foregoing protection layers, however, tend to increase the inherent turn-on energy of the heater resistor required for ejecting ink drops due to the insulating properties of the layers.

Some of the energy that is deposited by the heater resistors is not removed by the ejected ink drop as momentum or increased drop temperature, but remains as heat in the printhead or the remaining ink. As the temperature increases, the ink drop size can change and at some temperature, the printhead will no longer eject ink. Therefore it is important to control the amount of heat that is generated and that remains in the printhead during a printing operation. As more resistors are activated with higher frequencies of activation and are packed with greater density in the printhead, significantly more heat is retained by the printhead. Consequently, there must be a reduction in the amount of energy input to the printhead for higher frequencies and greater drop generator densities to be realized.

The heater resistors of a conventional inkjet printhead comprise a thin film resistive material disposed on an oxide layer of a semiconductor substrate. Electrical conductors are patterned onto the oxide layer and provide an electrical path to and from each thin film heater resistor. Since the number of electrical conductors can become large when a large number of heater resistors are employed in a high density (high DPI—dots per inch) printhead, various multiplexing techniques have been introduced to reduce the number of conductors needed to connect the heater resistors to circuitry disposed in the printer. See, for example, U.S. Pat. No. 5,541,629 "Printhead with Reduced Interconnections to a Printer" and U.S. Pat. No. 5,134,425, "Ohmic Heating Matrix". Each electrical conductor, despite its good conductivity, imparts an undesirable amount of resistance in the path of the heater resistor. This undesirable parasitic resistance uselessly dissipates a portion of the electrical energy which otherwise would be available to the heater resistor thereby contributing to the heat gain of the printhead. If the heater resistance is low, the magnitude of the current drawn to nucleate the ink vapor bubble will be relatively large resulting in the amount of energy wasted in the parasitic resistance of the electrical conductors being significant relative to that provided to the heater resistor. That is, if the ratio of resistances between that of the heater resistor and the parasitic resistance of the electrical conductors (and other components) is too small, the efficiency (and the temperature) of the printhead suffers with the wasted energy.

The ability of a material to resist the flow of electricity is a property called resistivity. Resistivity is a function of the material used to make the resistor and does not depend upon the geometry of the resistor of the thickness of the resistive film used to form the resistor. Resistivity is related to resistance according to:

$$R=eL/A$$

where R=resistance (Ohms); e resistivity (Ohm-cm); L=length of resistor; and A=cross sectional area of resistor. For thin film resistors typically used in thermal inkjet printing applications, a property commonly known as sheet resistance ($R_{sheet}$) is commonly used in analysis and design of heater resistors. Sheet resistance is the resistivity divided by the thickness of the film resistor, and resistance is related to sheet resistance by:

$$R=R_{sheet}(L/W)$$

where L=length of the resistive material and W=width of the resistive material. Thus, resistance of a thin film resistor of a given material and of a fixed film thickness is a simple calculation of length and width for rectangular and square geometries.

Most of the thermal inkjet printers available today use square heater resistors that have a resistance of 35 to 40Ω. If it were possible to use resistors with higher values of resistance, the energy needed to nucleate an ink vapor bubble would be transmitted to the thin film heater resistor at a higher voltage and lower current. The energy wasted in the parasitic resistances would be reduced and the power supply that provides the power to the heater resistors could be made smaller and less expensive.

As users of inkjet printers and printing devices have begun to desire finer detail in the printed output from their devices, the technology has been pushed into a higher resolution of ink drop placement on the medium. One of the common ways of measuring the resolution is the measurement of the maximum number of ink dots deposited in a selected dimension of the printed medium, commonly expressed as dots per-inch (DPI). The production of an increased DPI requires smaller drops. Smaller ink drops means a lowered drop weight and lowered drop volume for each drop. Production of low drop weight ink drops requires smaller structures in the printhead. Smaller drops and resultant dots means that more dots must be placed on the medium at a higher rate in order to maintain a reasonable speed of printing, i.e., the number of pages printed per minute. The increased speed of printing requires a higher rate of drop generator heater resistor activation. So, designers of inkjet printheads are faced with the problem of more drop generators (with their associated heater resistors) disposed over a smaller area of printhead being operated at an increased frequency. These requirements produce a higher density of heat resulting in higher temperatures. Furthermore, to energize the greater number of smaller drop generators, an increased number of electrical conductors is required on a smaller area of printhead substrate real estate.

One approach to resolving the heat problem has been to increase the size of the semiconductor substrate as a heat spreader and heat sink. This approach, however, leads to an unacceptably higher cost, since processed semiconductor material costs rise exponentially with increased area. Moreover, there is a strong motivation to maintain a constant sized silicon substrate to enable manufacturing of varying printhead performance levels on the same manufacturing equipment. It is possible to control printhead temperature by slowing the rate of heater resistor activation ñ the duty cycle of the heating pulses can be lower fi but this leads to a lower page per minute printing delivery and is unacceptable to the user of the printing device. The aforementioned multiplexing techniques have helped reduce the total number of conductors necessary to energize the heater resistors but additional improvements are necessary. The market requirement for higher quality printing at a rate of output that does not require long waiting periods for such print provides strong motivation for improvements in inkjet print cartridges. These improvements must, of course, be made without compromising reliability.

SUMMARY OF THE INVENTION

A high quality inkjet printhead includes a substrate having a multiplicity of heater resistors formed thereon at a density of at least six heater resistors per square millimeter. Each of the heater resistors has a total resistance of at least 70Ω. Each of the heater resistors also has an overlaying passivation thermal barrier characteristic adjusted to enable ejection of an ink drop of less than 6.5 ng with an energy impulse equal to or less than 1.4$\mu$ joules.

DETAILED DESCRIPTION OF A PREFERRED EMBODIMENT

In order to realize a high quality print output, high drop generator density, and high throughput without high printhead temperatures, control and reduction of energy input for small closely packed drop generators must be undertaken. To this end several unique improvements have been made and in some instances, combined, to yield improved print quality.

There are two major sources of heat generation ñ the heater resistor itself and the combined resistance of the energizing power thin film conductors and the thin film ground return conductors disposed on the semiconductor substrate. Each conventional heater resistor has a resistance of approximately 40Ω including the parasitic resistance of the thin film conductors on the substrate. With a high density of heater resistors for the drop generators, there exists a high density of thin film conductors with attendant parasitic resistance. In a conventional implementation, the parasitic resistance associated with each heater resistor can reach 10Ω, a significant fraction of the total resistance of a heater resistor connection and a significant contributor to the ohmic heating of the semiconductor substrate. A feature of the present invention is the use of higher resistance heater resistors. While there are several techniques for obtaining a higher resistance heater resistor for use in a thermal inkjet printer application, a preferred embodiment of the present invention utilizes a reconfiguration of thin film resistor geometries to yield higher resistance heater resistors.

Once the electrical energy has been coupled to the heater resistor and converted to heat energy thereby, the heat energy must be coupled to the ink in the most efficient manner. Another feature of the present invention is the improvement in the efficiency of coupling heat energy from the heater resistor to the ink.

Figure 1A:
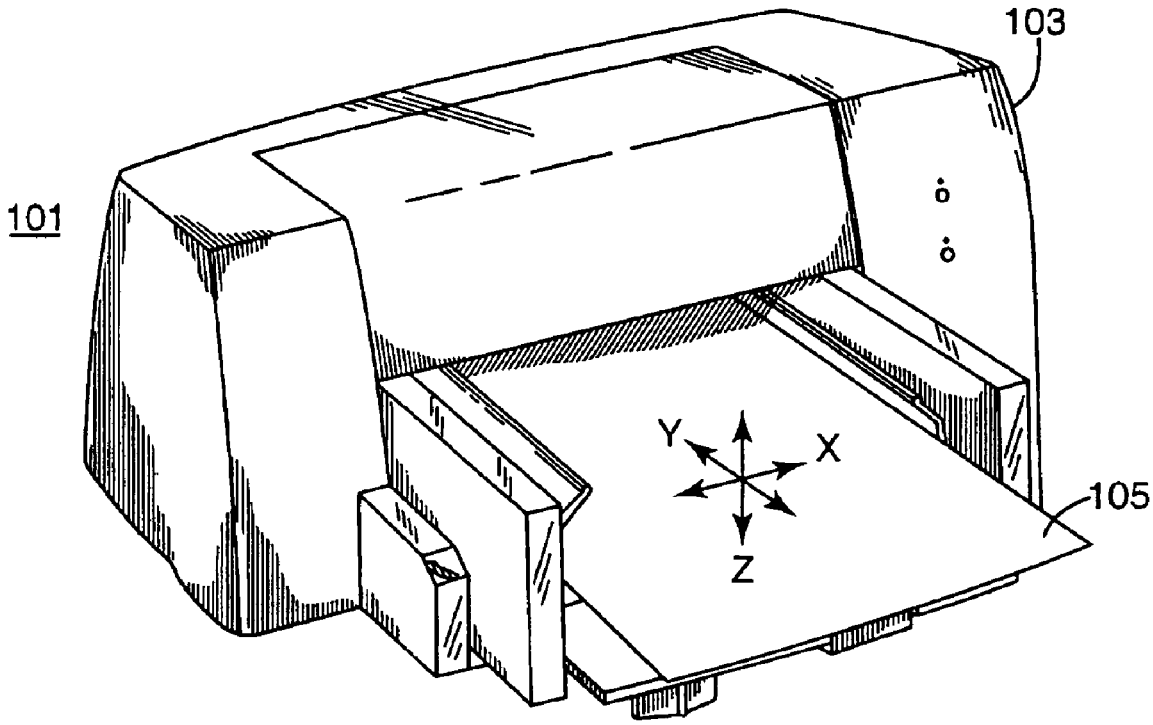
FIG. 1A is an isometric drawing of an exemplary printing apparatus which nay employ the present invention.
Figure 1B:
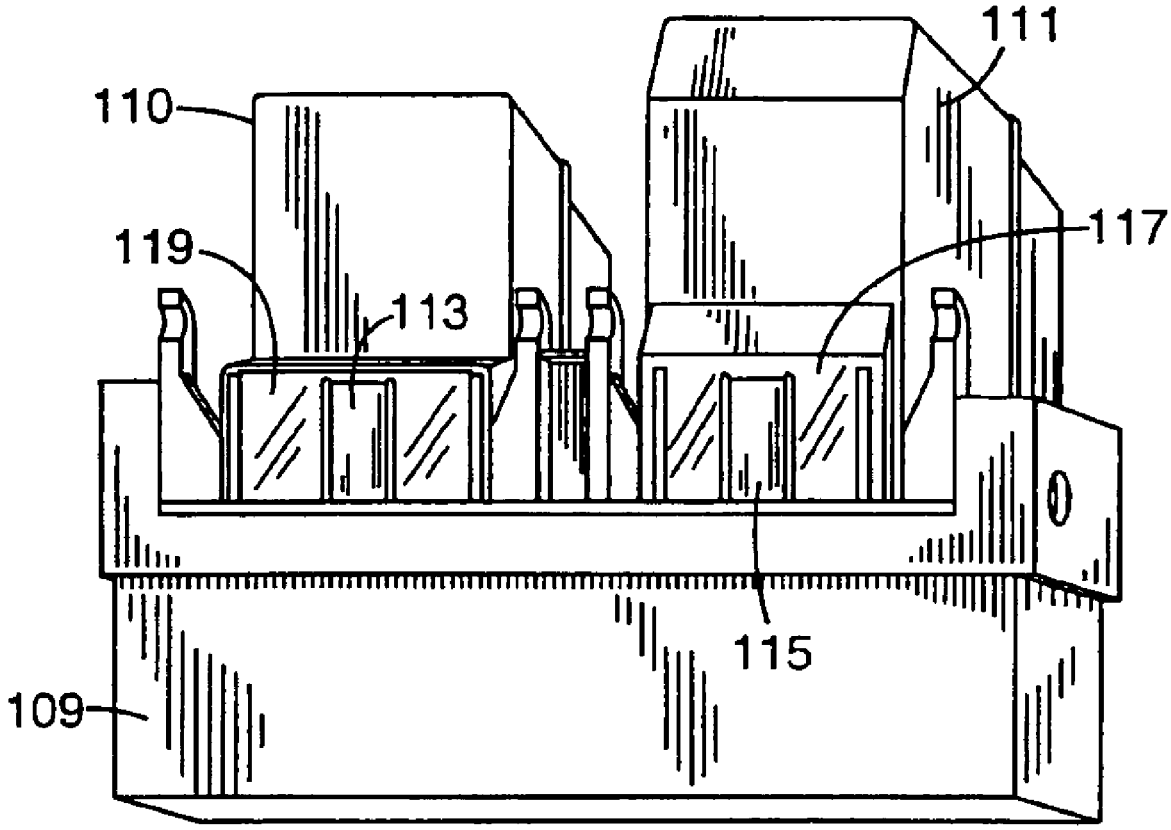
FIG. 1B is an isometric drawing of a print cartridge carriage apparatus which may be employed in the printing apparatus of FIG. 1A.

An exemplary inkjet printing apparatus, a printer 101, that may employ the present invention is shown in outline form in the isometric drawing of FIG. 1A. Printing devices such as graphics plotters, copiers, and facsimile machines may also profitably employ the present invention. A printer housing 103 contains a printing platen to which an input print medium 105, such as paper, is transported by mechanisms that are known in the art. A carriage within the printer 101 holds one or a set of individual print cartridges capable of ejecting ink drops of black or color ink. Alternative embodiments can include a semi-permanent printhead mechanism that is sporadically replenished from one or more fluidically-coupled off-axis ink reservoirs, or a single print cartridge having two or more colors of ink available within the print cartridge and ink ejecting nozzles designated for each color, or a single color print cartridge or print mechanism; the present invention is applicable to a printhead employed by at least these alternatives. A carriage 109, which may be employed in the present invention and mounts two print cartridges 110 and 111, is illustrated in FIG. 1B. The carriage 109 is typically supported by a slide bar or similar mechanism within the printer and physically propelled along the slide bar to allow the carriage 109 to be translationally reciprocated or scanned back and forth across the print medium 105. The scan axis, X, is indicated by an arrow in FIG. 1B. As the carriage 109 scans, ink drops are selectively ejected from the printheads of the set of print cartridges 110 and 111 onto the medium 105 in predetermined print swath patterns, forming images or alphanumeric characters using dot matrix manipulation. Generally, the dot matrix manipulation is determined by a user's computer (not shown) and instructions are transmitted to a microprocessor-based, electronic controller within the printer 101. Other techniques employ a rasterization of the data in a user's computer prior to the rasterized data being sent, along with printer control commands, to the printer. This operation is under control of printer driven software resident in the user's computer. The printer interprets the commands and rasterized data to determine which drop generators to fire. The ink drop trajectory axis, Z, is indicated by the arrow: When a swath of print has been completed, the medium 105 is moved an appropriate distance along the print media axis, Y, indicated by the arrow, in preparation for the printing of the next swath. This invention is also applicable to inkjet printers employing alternative means of imparting relative motion between printhead and media, such as those that have fixed printheads (such as page wide arrays) and move the media in one or more directions, those that have fixed media and move the printhead in one or more directions (such as flatbed plotters). In addition, this invention is applicable to a variety of printing systems, including large format devices, copiers, fax machines, photo printers, and the like.

The inkjet carriage 109 and print cartridges 110, 111 are shown from the −Z direction within the printer 101 in FIG. 1B. The printheads 113, 115 of each cartridge may be observed when the carriage and print cartridges are viewed from this direction. In a preferred embodiment, ink is stored in the body portion of each printhead 110, 115 and routed through internal passageways to the respective printhead. In an embodiment of the present invention which is adapted for multi-color printing, three groupings of orifices, one for each color (cyan, magenta, and yellow), is arranged on the foraminous orifice plate surface of the printhead 115. Ink is selectively expelled for each color under control of commands from the printer that are communicated to the printhead 115 through electrical connections and associated conductive traces (not shown) on a flexible polymer tape 117. In the preferred embodiment, the tape 117 is typically bent around an edge of the print cartridge as shown and secured. In a similar manner, a single color ink, black, is stored in the ink-containing portion of cartridge 110 and routed to a single grouping of orifices in printhead 113. Control signals are coupled to the printhead from the printer on conductive traces disposed on a polymer tape 119.

Figure 2B:
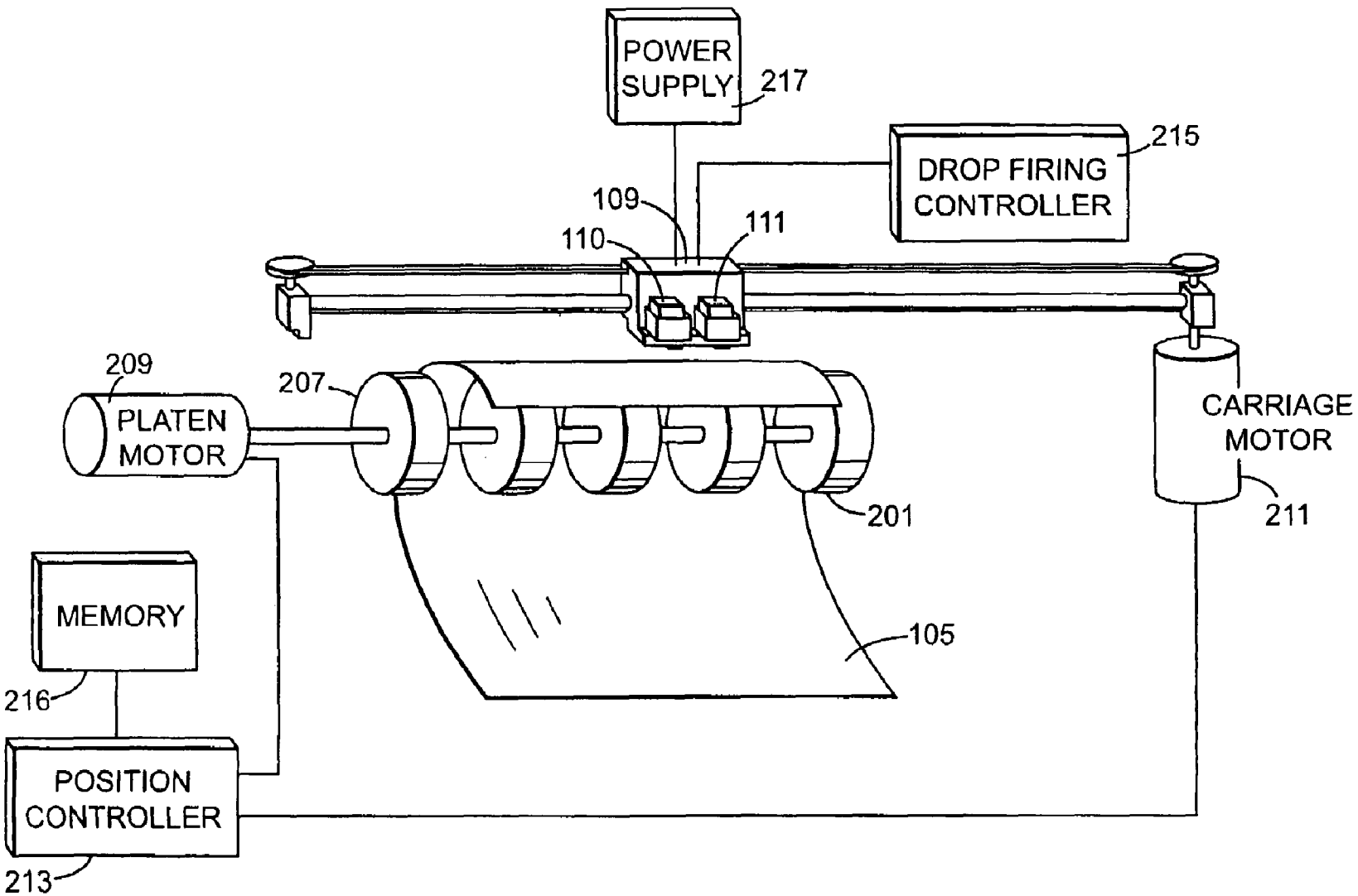
FIG. 2 is a schematic representation of the functional elements of the printer of FIG. 1A.

As can be appreciated from FIG. 2, a single medium sheet is advanced from an input tray into a printer print area beneath the printheads by a medium advancing mechanism including a roller 207, a platen motor 209, and traction devices (not shown). In a preferred embodiment, the inkjet print cartridges 110, 111 are incrementally drawn across the medium 105 on the platen by a carriage motor 211 in the =X direction, perpendicular to the Y direction of entry of the medium. The platen motor 209 and the carriage motor 211 are typically under the control of a media and cartridge position controller 213. An example of such positioning and control apparatus may be found described in U.S. Pat. No. 5,070,410 "Apparatus and Method Using a Combined Read/Write Head for Processing and Storing Read Signals and for Providing Firing Signals to Thermally Actuated Ink Ejection Elements". Thus, the medium 105 is positioned in a location so that the print cartridges 110 and 111 may eject drops of ink to place dots on the medium as required by the data that is input to a drop firing controller 215 and power supply 217 of the printer. These dots of ink are formed from the ink drops expelled from selected orifices in the printhead in a band parallel to the scan direction as the print cartridges 110 and 111 are translated across the medium by the carriage motor 211. When the print cartridges 110 and 111 reach the end of their travel at an end of a print swath on the medium 105, the medium is conventionally incrementally advanced by the position controller 213 and the platen motor 209. Once the print cartridges have reached the end of their traverse in the X direction on the slide bar, they are either returned back along the support mechanism while continuing to print or returned without printing. The medium may be advanced by an incremental amount equivalent to the width of the ink ejecting portion of the printhead or some fraction thereof related to the spacing between the nozzles. Control of the medium, positioning of the print cartridge, and selection of the correct ink ejectors for creation of an ink image or character is determined by the position controller 213. The controller may be implemented in a conventional electronic hardware configuration and provided operating instructions from conventional memory 216. Once printing of the medium is complete, the medium is ejected into an output tray of the printer for user removal.

Figure 3:
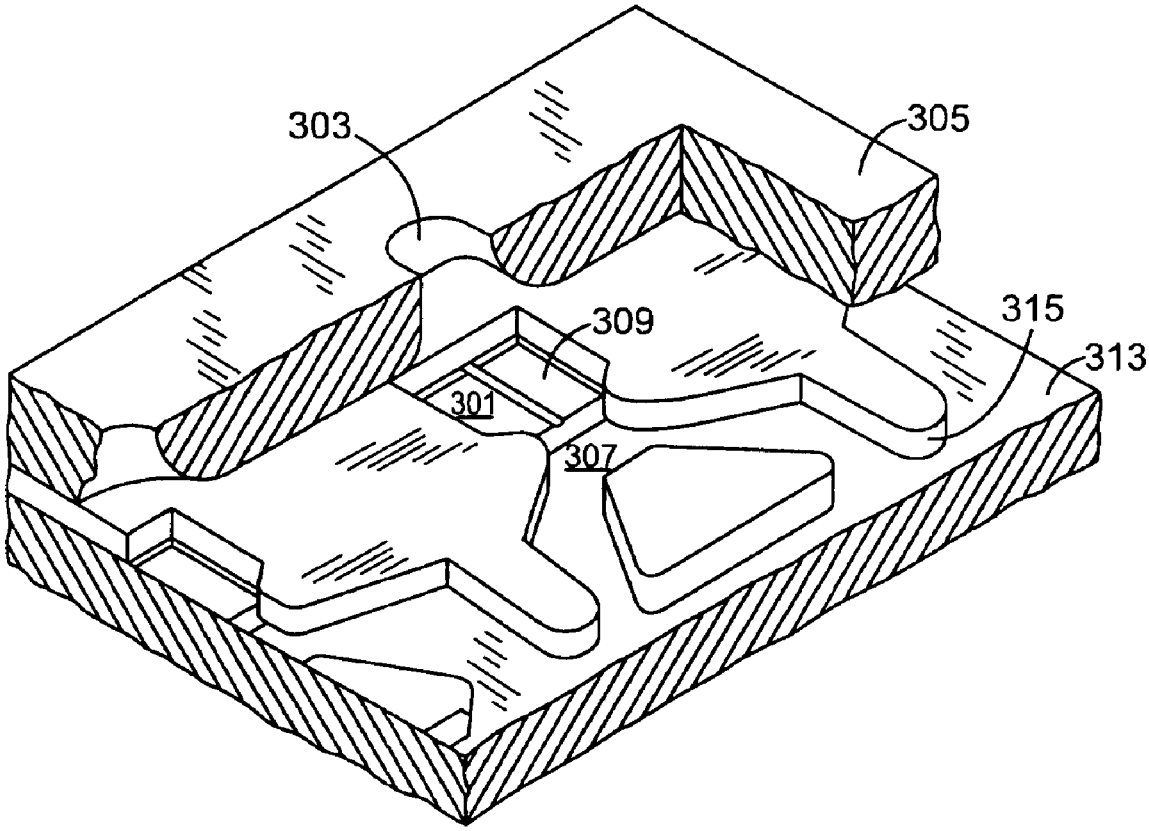
FIG. 3 is a magnified isometric cross section of a drop generator which may be employed in the printhead of the print cartridge of FIG. 1B.
Figure 5:
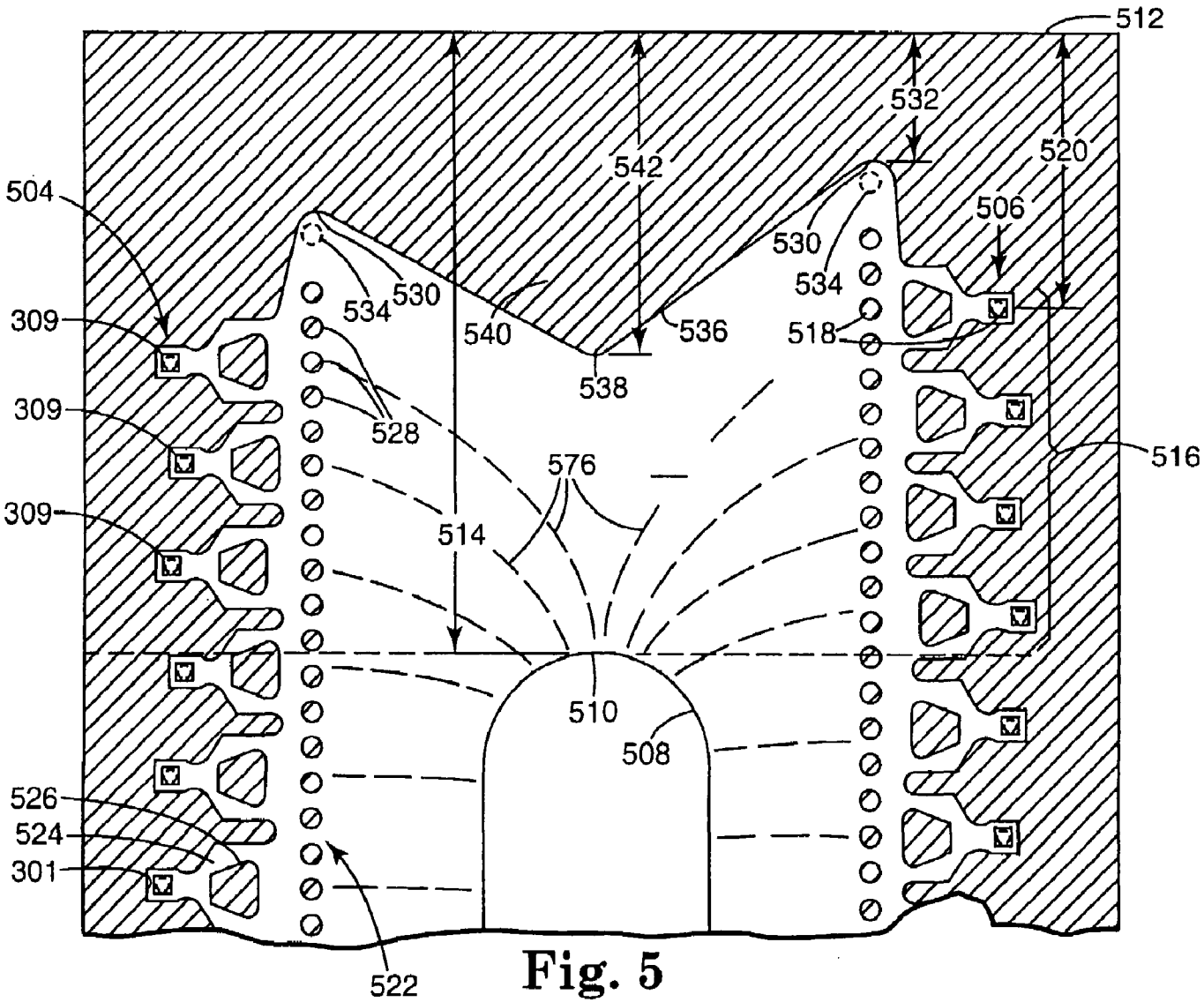
FIG. 5 is a plan view of a printhead illustrating a patterned barrier layer which may be employed in a print cartridge of FIG. 1B.

A single example of an ink drop generator found within a printhead is illustrated in the magnified isometric cross section of FIG. 3. As depicted, the drop generator comprises a nozzle, a firing chamber, and an ink ejector. Alternative embodiments of a drop generator employ more than one coordinated nozzle, filing chamber, and/or ink ejectors. The drop generator is fluidically coupled to a source of ink. In a preferred embodiment, the heater resistor 309 has a resistance of at least 70Ω to reduce parasitic power losses through leads that provide power to the resistor. In a preferred embodiment, the heater resistor has a resistance of about 140Ω, measured from between pads on the print cartridge 110 or 111 that utilizes the heater resistor 309. This unconventionally high resistance, in contrast to the 30 to 40Ω used in most conventional print catridges, can be accomplished by reducing thickness or increasing resistivity of a thin film layer used for fabricating resistor 309. Alternatively, a segmented design can be used, as depicted in FIGS. 3 and 5 and discussed below.

In FIG. 3, the preferred embodiment of an ink firing chamber 301 is shown in correspondence with a nozzle 303 and a segmented heater resistor 309. Many independent nozzles are typically arranged in a predetermined pattern on the orifice plate 305 so that the ink drops are expelled in a controlled pattern. Generally, the medium is maintained in a position which is parallel to the plane of the external surface of the orifice plate. The heater resistors are selected for activation in a process that involves the data input from an external computer or other data source coupled to the printer in association with the drop firing controller 215 and power supply 217. Ink is supplied to the firing chamber 301 via opening 307 to replenish ink that has been expelled from orifice 303 following the creation of an ink vapor bubble by heat energy released from the segmented heater resistor 309. The ink firing chamber 301 is bounded by walls created by: the orifice plate 305, a layered semiconductor substrate 313, and barrier layer 315. In a preferred embodiment, fluid ink stored in a reservoir of the cartridge housing flows by capillary force to fill the firing chamber 301.

Figure 4:
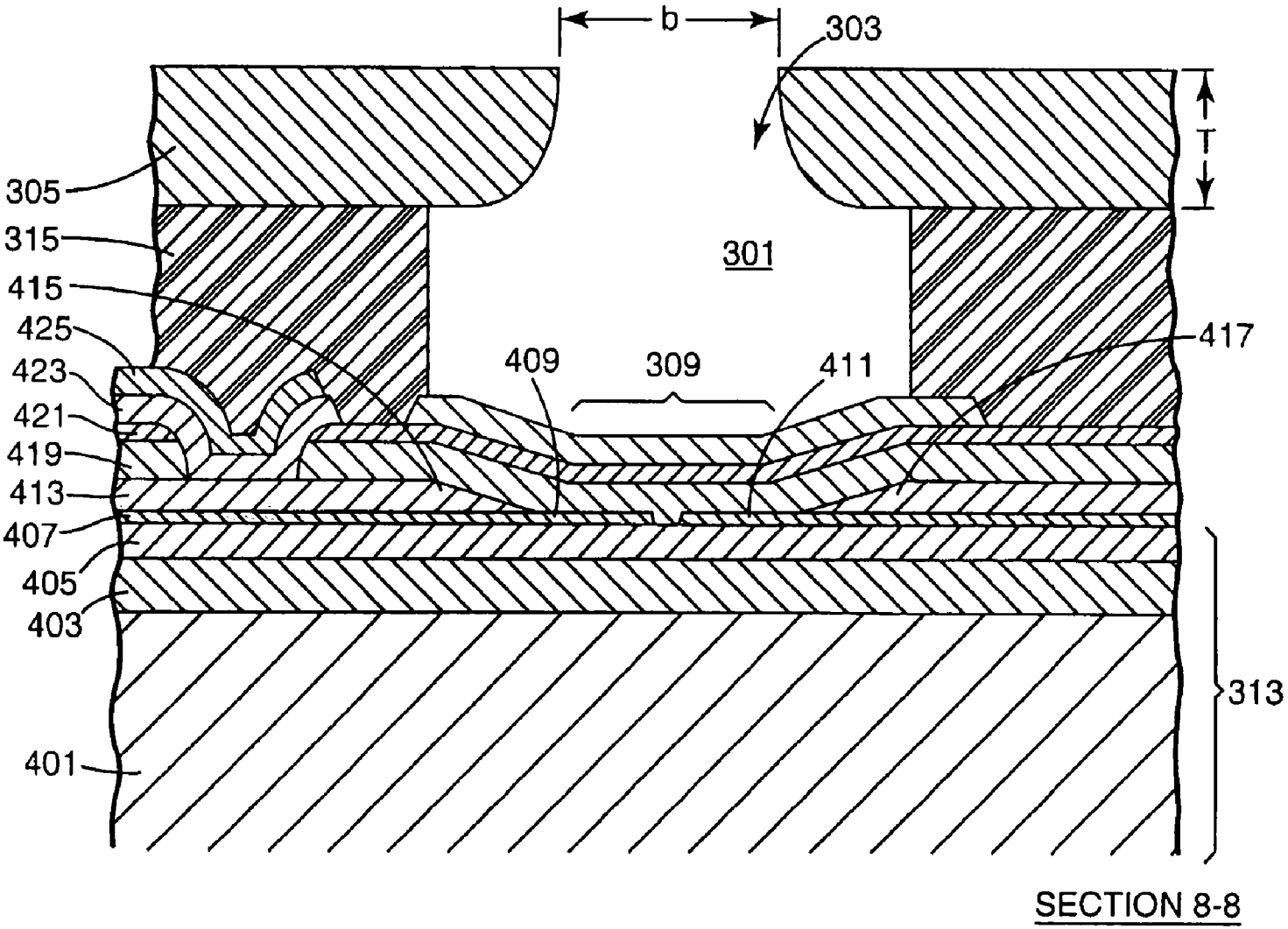
FIG. 4 is a cross sectional elevation view of the drop generator of FIG. 3, taken as a cross section of the beater resistor as shown in FIG. 8A, illustrating the layers of material that form a drop generator useful in the present invention.

In FIG. 4, a cross section of the firing chamber 301 and the associated structures are shown. The substrate 313 comprises, in the preferred embodiment, a semiconductor base 401 of silicon, treated using either thermal oxidation or vapor deposition techniques to form a thin layer 403 of silicon dioxide and a thin layer 405 of phospho-silicate glass (PSG) thereon. The silicon dioxide and PSG forms an electrically insulating layer approximately 17000 Å thick upon which a subsequent layer 407 of tantalum-aluminum (TaAl) resistive material is deposited. The tantalum-aluminum layer is deposited to a thickness of approximately 900 Å to yield resistivity in the range of 27.1Ω per square to 31.5Ω per square and preferably at a value of 29.3Ω per square. In a preferred embodiment, the resistive layer is conventionally deposited using a magnetron sputtering technique and then masked and etched to create discontinuous and electrically independent areas of resistive material such as areas 409 and 411. Next, a layer 413 of aluminum-silicon-copper (Al—Si—Cu) alloy conductor is conventionally magnetron sputter deposited to a thickness of approximately 5000 Å atop the tantalum aluminum layer areas 409, 411 and etched to provide discontinuous and independent electrical conductors (such as conductors 415 and 417) and interconnect areas. To provide protection for the heater resistors and the connecting conductors, a composite layer of material is deposited over the upper surface of the conductor layer and resistor layer. A dual layer of passivating materials includes a first layer 419 of silicon nitride ($Si_3N_4$) in a range of 2350 Å to 2800 Å thick which is covered by a second layer 421 of inert silicon carbide (SiC) in a range of 1000 Å to 1550 Å thick. This extraordinary thin passivation layer (419, 421) provides both good adherence to the underlying materials and good protection against ink corrosion. It also provides electrical insulation. Of significance to the present invention, the passivation layer is reduced in thickness to increase heat flow from the heater resistor to the ink in chamber 301 as opposed to having a significant heat flow into the substrate. An area over the heater resistor 309 and its associated electrical connection is subsequently masked and a cavitation layer 423 of tantalum in a range of 2500 Å to 3500 Å thick is conventionally sputter deposited. A gold layer 425 may be selectively added to the cavitation layer in areas where electrical interconnection to the flexible conductive tape 119 (or 117) is desired. An example of semiconductor processing for thermal inkjet applications may be found in U.S. Pat. No. 4,862,197, "Process for Manufacturing Thermal Inkjet Printhead and Integrated Circuit (IC) Structures Produced Thereby." An alternative thermal inkjet semiconductor process may be found in U.S. Pat. No. 5,883,650, "Thin-Film Printhead Device for an Ink-Jet Printer."

In a preferred embodiment, the sides of the firing chamber 301 and the ink feed channel are defined by a polymer barrier layer 315. This barrier layer, in one embodiment, is preferably made of an organic polymer plastic that is substantially inert to the corrosive action of ink and is applied using conventional techniques upon substrate 313 and its various protective layers. To realize a structure useful for printhead applications, the barrier layer is subsequently photolithographically defined into desired shapes and then etched. In the preferred embodiment, the barrier layer 315 has a thickness of about 15 $\mu$m after the printhead is assembled with the orifice plate 305.

FIG. 5 shows the barrier layer and substrate at one end of the print head. The other end is the same, with numerous intermediate features repeated between the ends. The heater resistors 309 are arranged in a first row 504 and a second row 506, with the resistors being evenly spaced apart in each row. The rows are axially offset by one-half of the resistor spacing to provide an evenly alternating arrangement that provides a higher resolution printed swath. The substrate in an ink supply opening 508 is an elongated oblong slot, with only a single end shown in FIG. 5. In alternative embodiments, the ink supply opening may be an array of end-to-end oblong or circular boles having the same total end-to-end length. The slot end 510 is spaced apart from the substrate edge 512 by a slot spacing distance 514. This must be more than a minimal amount to ensure that the substrate has structural integrity against breakage.

An end resistor zone 516 extends beyond the end of the slot 518, and in a preferred embodiment, includes several beater resistors. These end resistors do not receive ink flow from the ink slot 508 on a direct lateral path as do the remaining resistors. The end resistors receive ink flow that takes a longer path 516 having a directional component parallel to the slot axis. The most remote resistor 518 is spaced apart from the substrate edge 512 by a spacing 520. This spacing is as small as possible to provide a wide swath from a given substrate dimension, to minimize component costs.

The barrier defines a firing chamber 301 for each heater resistor. The firing chamber extends laterally away from an ink manifold 522, and is connected via an antechamber 524 containing a flow control island 526 formed as part of the barrier layer. The island creates tapered ink passages that provide redundant flow paths. A row of barrier pillars 528 is positioned between the ink supply slot and the firing chambers, and serves to deter passage of any contaminant particles or larger air bubbles into the firing chambers.

At the end of the ink manifold chamber 522 along each major edge defined by the pillars 528, the manifold terminates in corners 530. The most remote corner extends to within a spacing 532 from the substrate edge 512, and each corner encompasses an optional non-firing orifice 534 in the orifice plate above, so that air trapped may be released from the manifold. The spacing 534 is minimized to provide efficient substrate usage as noted above, and is limited by tolerances and the need for a minimum width of barrier material to ensure the integrity of the manifold seal.

At the ends of the manifold, the barrier forms an end wall 536 that protrudes inwardly into the manifold at a central vertex 538, Thus, a wedge 540 of barrier material extends into the manifold. The vertex of the wedge is spaced apart from the substrate edge 512 by a spacing 542, which is greater than the end resistor spacing 520. The vertex protrudes sufficiently to intervene between the endmost resistors of each row, and extends beyond the manifold corner 530 by a distance (equal to spacing 542 minus spacing 532) of about four times the pitch of the resistors. The vertex protrudes toward the slot end 510 to narrow that distance (measured by spacing 514 minus spacing 542) to less than two-thirds of what it would be if the end wall 536 extended straight between the corners 530.

By occupying part of what would have been a vacant ink manifold portion, the protrusion or wedge fills a location where ink flow would have been slow or stagnant, and where small bubbles may have aggregated and coalesced By eliminating this stagnant region, the remaining manifold regions arc continually flushed by the ink supply as the resistors fire. This deters microscopic air bubbles that may normally arise during the life of the print cartridge from coalescing into large air bubbles that would otherwise begin to fill the manifold ends, and eventually block some of the end ink emitting nozzles. In addition, by forcing a reduced path length to the end nozzles, the wedge reduces the time the ink spends in the manifold at the ends, limiting the amount of time in which it may outgas air bubbles. In an alternative embodiment, additional barrier layer pillars may be positioned between the end 510 of the ink supply opening and the end wall 536 to further retard large air bubble interference with the ejection of ink.

The orifice plate 305 is secured to the substrate 313 by the barrier layer 315. In an alternative embodiment, print cartridges the orifice plate 305 is constructed of nickel with plating of gold to resist the corrosive effects of the ink. In other print cartridges, the orifice plate is formed of a polyamide material that can be used as a common electrical interconnect structure. In an alternative embodiment, the orifice plate and barrier layer is integrally formed on the substrate. When the orifice plate is constructed of metal, the metal orifice plate 305 is typically produced by electroforming nickel on a mandrel having insulating features with appropriate dimensions and suitable draft angles to produce the features desired in the orifice plate. Upon completion of a predetermined amount of time, and after a thickness of nickel has been deposited, the resultant nickel film is removed and treated for use as an orifice plate. Typically, the nickel orifice plate is then coated with a relatively non-reactive metal such as gold, platinum, palladium, or rhodium to resist corrosion. Following its fabrication, the orifice plate is affixed to the semiconductor substrate 401 and its thin film layers with the barrier material 315. The orifices (for example orifice 303 in FIGS. 3 and 4) created by the electroforming of the nickel on the mandrel extend from the inner surface of the orifice plate 305 to the outer surface of the orifice plate. In a preferred embodiment, the orifices of the orifice plate, after treatment and plating, provide an opening on the outer surface of the orifice plate 305, diameter b, having a range of between 10.5 $\mu$m and 14.5 $\mu$m. The thickness, T, of the nickel orifice plate is in the range of between 20 $\mu$m but less than 30 $\mu$m.

Figure 6A:
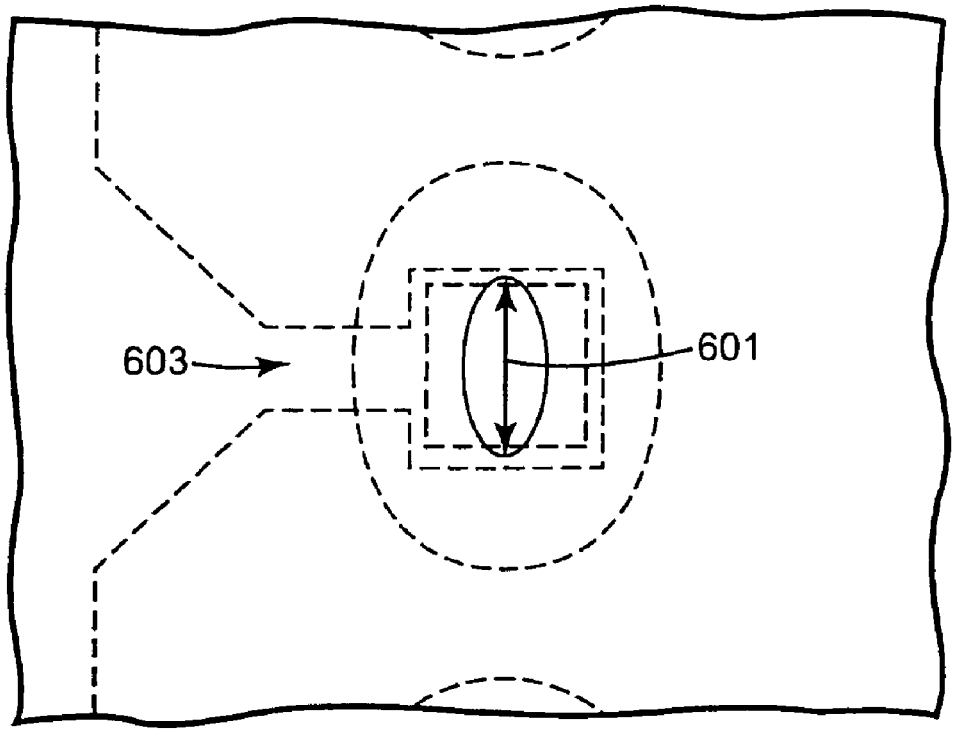
FIGS. 6A–6D are plan views of an orifice plate top surface, including an ink-ejecting orifice opening, which may be used in a print cartridge of FIG. 1B.
Figure 6B:
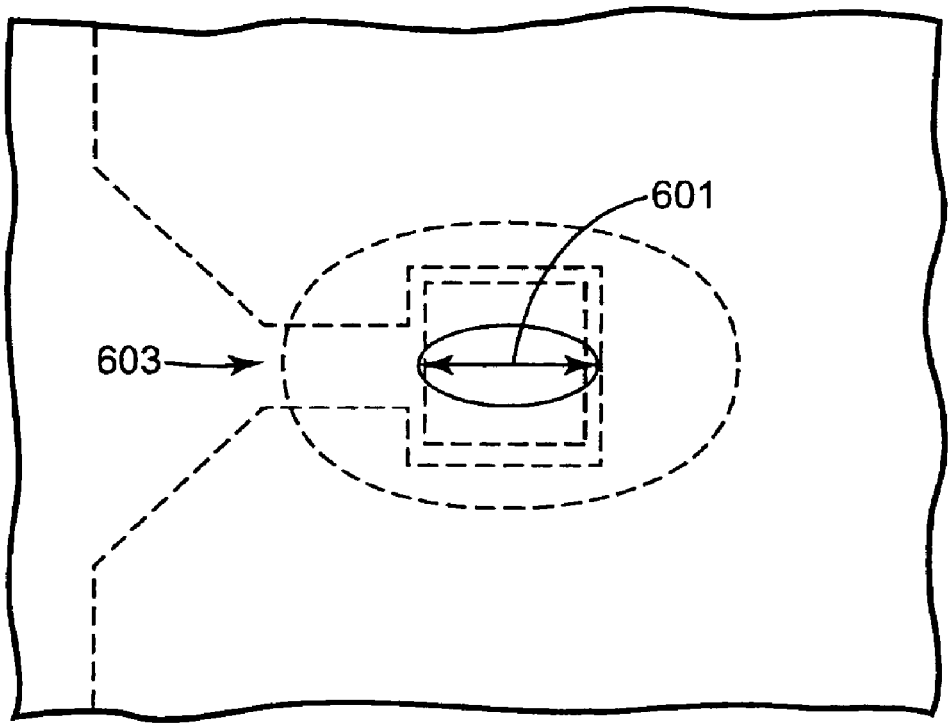
Figure 6C:
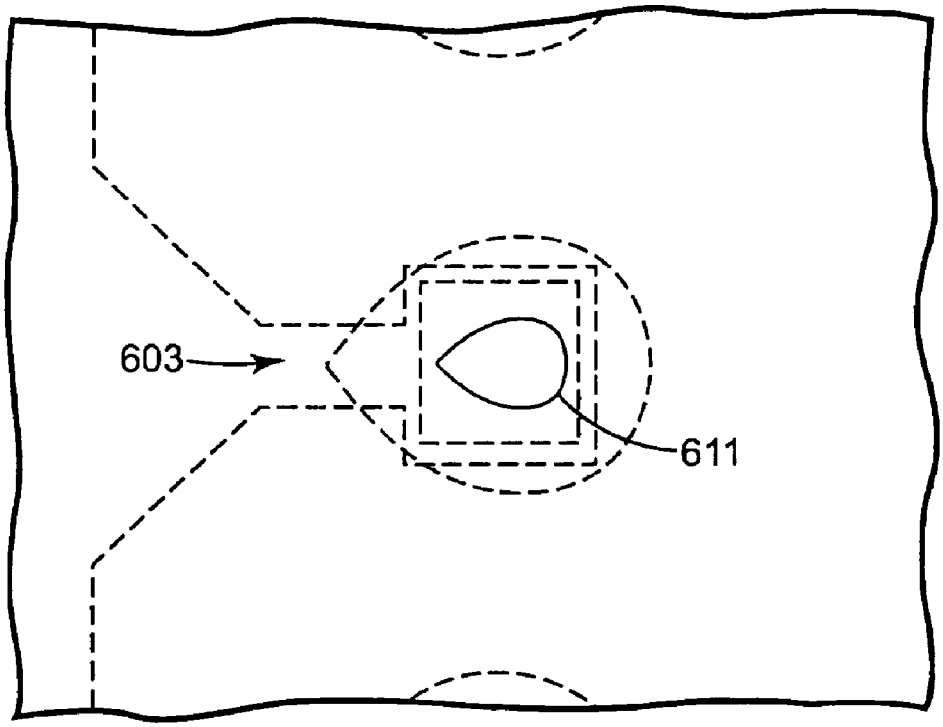
Figure 6D:
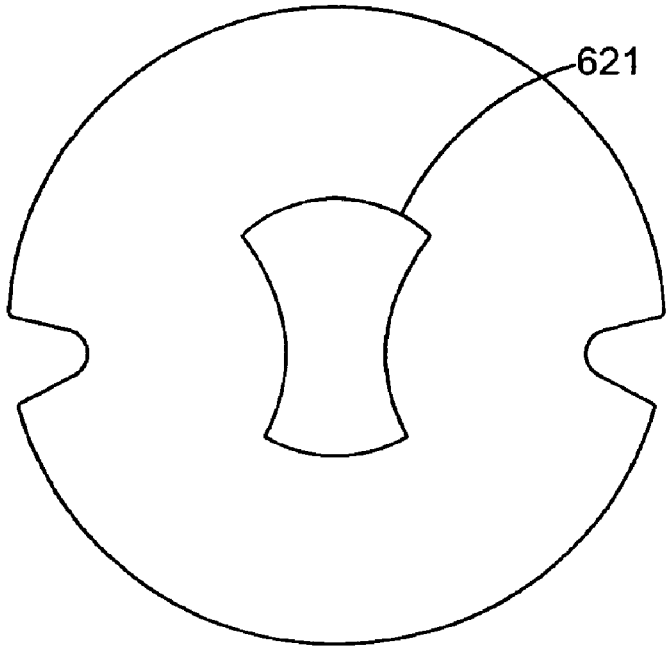

In an alternative embodiment, orifice surface openings are made asymmetrical to provide increased control over the direction of ink drop ejection, reliable placement of ink dots on the medium, and a reduction of satellite droplets and spray. To this end, orifice openings may be created in the form of an ellipse, as shown in the orifice plate outer surface plan view of FIGS. 6A and 6B. Here, the major axis 601 to minor axis ratio falls in the range of 2:1 to 5:1. The direction of the major axis 601 can be oriented perpendicular to the direction of ink refill into the ink fill channel 603 from the ink source (FIG. 6A) or parallel to the direction of ink refill (FIG. 6B) or a beneficial angle in between. The narrower minor axis produces a stiffer meniscus at the ends of the ellipse that have the sharper radius of curvature and preferentially separates the ejected ink drop from the remainder of the ink in the firing chamber at the sharper radius of curvature. An orifice opening having a single location of a sharp radius of curvature and preferential ink drop separation point is shown in FIG. 6C. An orifice opening having a narrow end with a relatively sharp-radius of curvature but with an empirically determined improved drop ejection characteristic is that of an "hourglass" shaped orifice opening, as shown in FIG. 6D.

Stability of the ink drop ejection at high operating frequencies is affected by how well the firing chamber of the ink drop generators fill with ink after each drop ejection. If the fluid characteristics of an ink flow channel within a drop generator are too underdamped, the ink refilling the firing chamber will slosh back and forth, causing the drop weight of ejected ink drops to vary unpredictably as the operating frequency varies. This is because some ink drops are ejected when the firing chamber contains more ink, resulting in larger drops, and some ink drops are ejected when the firing chamber contains less ink, resulting in smaller drops, with minimal ability to predict when these extremes will occur. The present invention uses an overdamped structure for the firing chamber of each drop generator that is designed to eliminate this sloshing or ringing effect so that ink drop weights can be better predicted and controlled.

Another printing stability issue is that of "decel". Decel is a decrease of drop velocity over time during a single firing burst. A preferred embodiment of the present invention addresses this instability by using an additive in the ink composition that greatly reduces the amount of decel. Preferably, the ink contained within the ink supply contains the additive, which is explained in detail below. This combination of printhead architecture and ink composition allows the printing device to achieve high-speed, high-resolution printing.

In a working example of the present invention, each ink drop weighs less than 8 ng, with a preferred drop weight of approximately 5 ng and a range of 3.5 ng to 6.5 ng achieving the highest photographic-quality print. Lower drop weights, however, may be utilized with the present invention. Preferably, the ink drop generators operate at 18 KHz in bidirectional printing mode with an ink drop weight of approximately 5 ng. At this high frequency and low drop weight there are increased power requirements for ejecting the ink drops. For example, when the drop weight is reduced from 10 ng to 5 ng the power required for a conventional resistor drops only about 15%. If the number of resistors is doubled, as in this working example, it can be seen that the power required to energize the resistors is greatly increased.

Maximum firing frequency of the present invention is determined theoretically by how quickly the firing chamber of the ink, drop generator refills. A wide entrance from an ink source to the firing chamber provides a faster refill time and increases the firing frequency. However, a sufficiently wide entrance can be underdamped and consequently can have the severe disadvantage of generating widely varying drop ejection characteristics resulting in a major degradation of print quality. The ink drop instability that results in an unpredictable area of coverage on the print medium during printing or even ink pooling around the firing chamber (known as "puddling"). Puddling can alter the trajectory of ejected drops or even shut down firing chamber operations.

One aspect of the present invention uses a printhead architecture that is overdamped. An overdamped printhead experiences little or no fluid oscillation and hence has a predictable firing chamber behavior. The overdamped printhead of the present invention utilizes a combination of ink properties along with barrier and orifice geometry to provide a drop generator with a predictable drop volume. This drop volume is constant below a certain critical firing frequency and then slowly decreases above the critical frequency. The overdamped drop generator of the present invention does not exhibit the trajectory or mussing drop problems associated with puddling.

Figure 7:
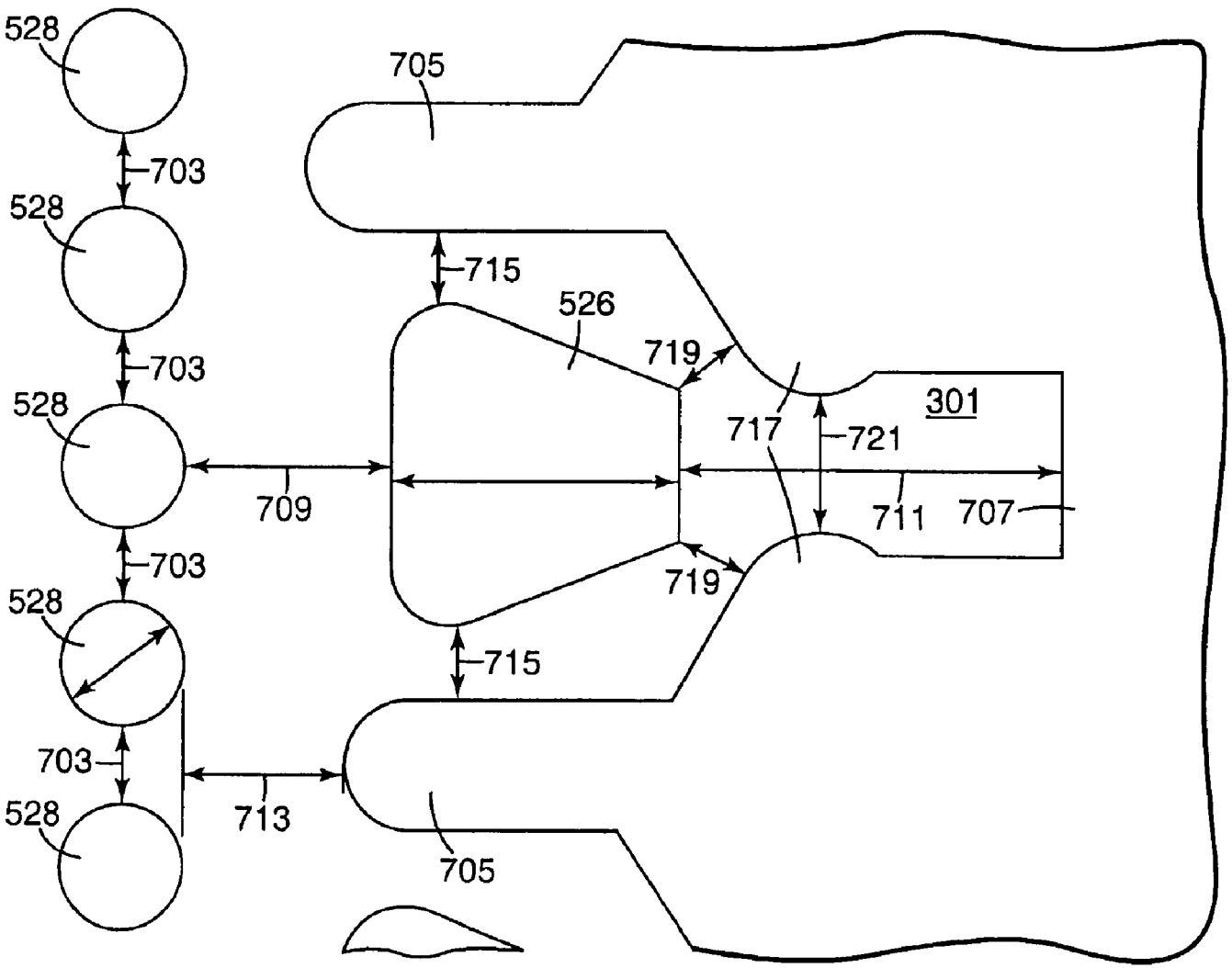
FIG. 7 is a plan view of a printhead barrier layer which may be employed in the print cartridge of FIG. 1B.

In an exemplary embodiment, the overdamped structure is formed using at least one constriction (known as a "pinch point") in an entrance channel formed between an ink source and each firing chamber. The firing chamber 301 is shown in FIG. 7. Ink flows from the ink feed slot passing through the semiconductor substrate past a row of outer barrier features, pillars 528, past an inner barrier feature, the flow control island 526, and to the firing chamber 301. The distance between adjacent pillars 528 defines an outer pinch point 703. In a preferred embodiment the outer pinch point 703 is approximately 10 $\mu$m. Moreover, the pillars 528 are circular with a diameter of approximately 18 $\mu$m, although other shapes and sizes may be used to form the pillars. The island 526 is positioned between peninsulas 705, the pillars 528, and a firing chamber end boundary 707. In this working example, the distance 709 between the pillars 528 and island 526 is approximately 28 $\mu$m, while the distance 711 between the island 526 and the firing chamber end boundary 705 is approximately 54 $\mu$m. Moreover, the distance 713 between tips of the peninsulas 703 and the pillars 528 in this example is approximately 21 $\mu$m.

The distance between the island 526 and the peninsulas 705 defines a first intermediate pinch point 715. In this example, the first intermediate pinch point 715 is approximately 10 $\mu$m. The distance between the island 526 and entrance protrusions 717 defines a second intermediate pinch point 719. In this example, the second intermediate pinch point 719 is approximately 10 $\mu$m. Further, the distance between the entrance protrusions 717 defines an inner pinch point 721 that, in this example, is approximately 20 $\mu$m wide.

The combination of pinch points (the outer pinch point 703, the first intermediate pinch-point 715, the second intermediate pinch point 719 and the inner pinch point 721) used in the present invention offers several advantages. In particular, the combination of pinch points, when used with proper ink properties, provides an overdamped drop generator that eliminates ink drop volume instabilities. In a preferred embodiment, to provide an ejected ink drop weight of approximately 5 ng, the orifice is less than 15 $\mu$m in diameter and is preferably 12.5 $\mu$m with a range of 10.5 $\mu$m to 1514.5 $\mu$m. In this configuration, and with pinch points of 10 $\mu$m, particles that would tend to block the orifice are filtered from the ink before they can reach the orifice and possibly shut down firing chamber operations. The pillars and islands 528, 526 provide redundant ink flow paths between a source of ink and the orifice. Further, in order to provide proper damping and filtration, the barrier layer is less than 20 $\mu$m thick, and is preferably about 15 $\mu$m, with a preferred range of 10 $\mu$m to 18 $\mu$m. The proper volume or column of ink above the resistor is provided by employing an orifice layer that is less than 30 μm thick and preferably is approximately 25 μm thick, with a preferred range of 20 μm to 30 μm thick.

Another aspect of the present invention is ensuring that the ink can successfully be used with the high-frequency printing system. One aspect involves alleviating any ink stability caused by decel. Decel is a phenomenon occurs during a high-frequency printing burst and decreases the velocity and stability of the ink due to residue on the resistor. The ink instability and loss of ink drop velocity can cause unacceptable variations in the quality of the print.

A preferred embodiment of the present invention uses ink that comprises an aqueous vehicle and a decel-alleviating component. This component is capable of undergoing rapid thermal decomposition when heated to greatly reduce the residue left by the ink- during high-frequency printing bursts. Preferably, the decel-alleviating component is a liquid-soluble compound capable of undergoing a rapid, preferably exothermic, thermal decomposition upon heating. Further, the decel-alleviating component preferably includes a salt with a cationic component and an anionic component having reducing or oxidizing capabilities. The decomposition products of the decel-alleviating component are preferably a gas or liquid and not a solid. In a preferred embodiment of the present invention, the decel-alleviating compound is ammonium nitrate added at 1% by weight. Alternatively, other decel-alleviating components may be used (such as $NH_4NO_3$ and $NH_4NO_2$).

In order to achieve a proper level of damping. the viscosity of the ink is preferably between approximately 2 to 5 centipoise, with a preferred value of 3.2 centipoise. Further, the surface tension of the ink should be kept between about 20–40 dynes per centimeter, with a preferred value of 29 dynes per centimeter.

Keeping the surface tension and viscosity of the ink within these ranges and using the ink composition discussed above to reduce decel generally ensures that the ink can successfully be used with the high-frequency printing system of the present invention.

Figure 8A:
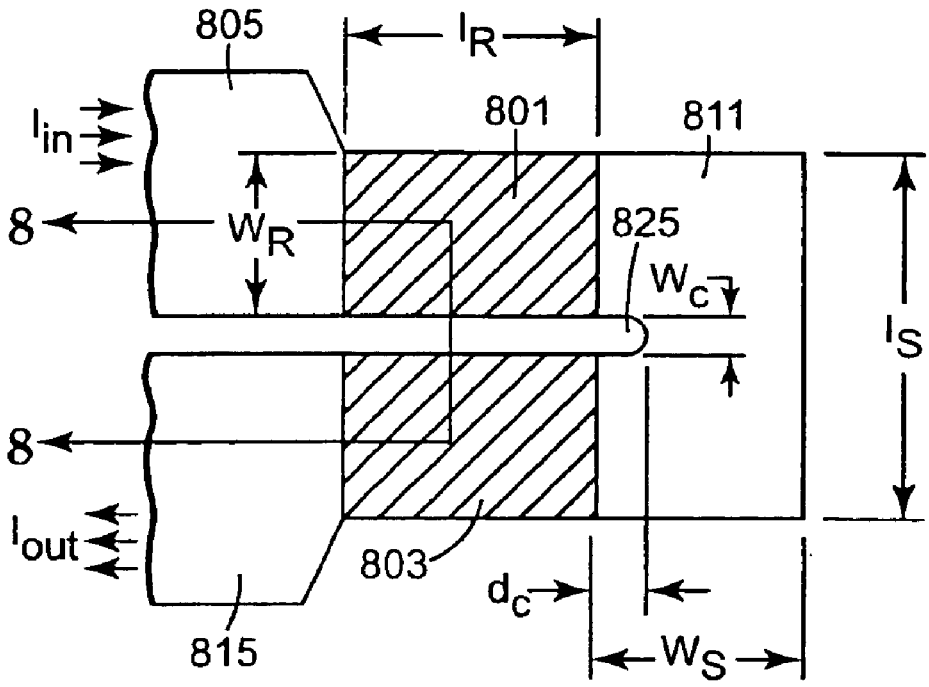
FIGS. 8A–8C are plan views of a segmented heater employing a shorting bar useful in a printhead employing the present invention.

In a preferred embodiment of the present invention, a heater resistor having a higher value of resistance is employed to overcome some of the excess heat deposition problem stated above, in particular the problem of undesired energy dissipation in the parasitic resistance. The implementation of a higher value resistance heater resistor is that of revising the geometry of the heater resistor, specifically that of providing two segments having a greater length than width. Since it is preferred to have the heater resistor 309 located in one compact spot for optimum vapor bubble nucleation in a top-shooting (ink drop ejection perpendicular to the plane of the heater resistor) printhead, the resistor segments are disposed long side to long side as illustrated in FIG. 8A. As shown, heater resistor segment 801 is disposed with one of its long sides essentially parallel to the long side of heater resistor segment 803. Electrical current $I_{in}$ is input via conductor 805 to the resistor segment 801 disposed at one of the short sides (width) edges of resistor segment 801. The electrical current, in the preferred embodiment, is coupled to the input of the resistor segment 803 disposed at one of the short side (width) edges of resistor segment 803 by a coupling device that has been termed a "shorting bar" 811. The shorting bar is a portion of conductor film disposed between the output of heater resistor segment 801 and the input of heater resistor segment 803. The electrical current $I_{out}$ is returned to the power supply via conductor 815 connected to the output of heater resistor segment 803. As shown, with no additional electrical current sources or sinks, $I_{in}=I_{out}$. The outputs of heater resistor segments 801 and 803, respectively, are disposed at the opposite short side (width) edges of the heater resistor segments from the input ports.

Figure 8B:
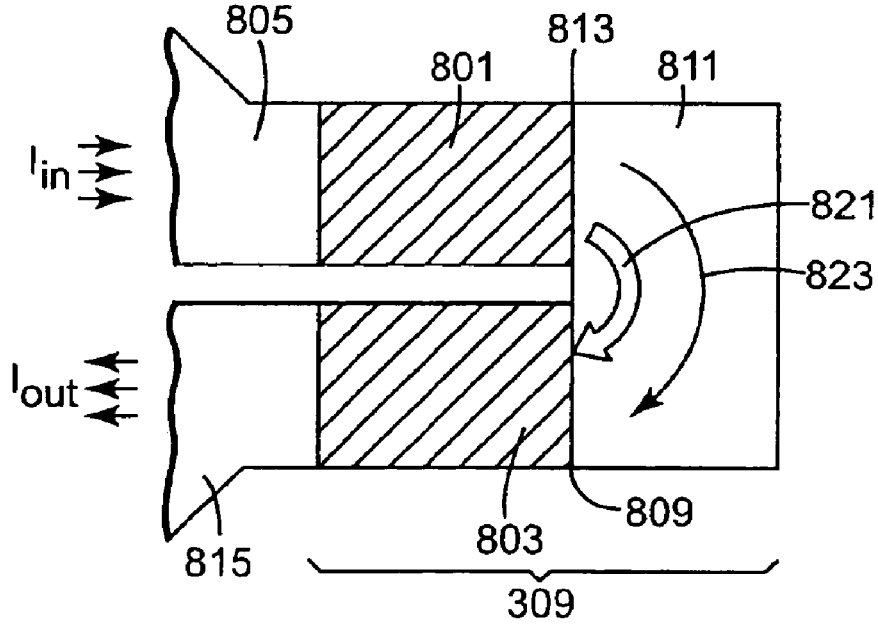

By placing the two resistor segments in a compact area, it is necessary for the electric current to change direction by way of the coupling device or shorting bar portion 811. Because the path of the electrons comprising the electric current is shorter between the two proximate corners of the heater resistor segments (causing the parasitic resistance of the shorter path to be less than the longer path), more of the electric current flows in this shorter path, illustrated by arrow 821 in FIG. 8B, than any other path, illustrated by arrow 823. This concentration of current has been termed "current crowding". High current density produced by such current crowding will reduce the life of electronic circuits because it creates locally elevated temperatures and creates high electric field strengths that induce electromigration. In applications where the electric current is cycled on and off, such as in a thermal inkjet printhead, the rapid thermal variation causes expansion and contraction of the printhead substrate and the thin film layers disposed thereon. In areas having differential thermal expansion and contraction amounts because of the differences in thermal expansion rates of different materials, such as at the junction of a heater resistor segment and the conductor shorting bar, material fatigue stresses will cause an early failure.

With careful attention to design tolerances and material selection, lifetimes of the segmented resistor—shorting bar configuration will survive the useful lifetime of the print cartridge. It has been found, however, that thin film deposition alignment tolerances and the slope of the etched conductive metal in the direction normal to the substrate surface can result in the shorting bar being placed not only at the ports of the heater resistor segments but also between the long sides of the heater resistor segments. An exaggerated representation of this condition is depicted in FIG. 8C.

A portion 820 of the shorting bar 811 has been undesirably deposited between the long dimensions of heater resistor segments 801 and 803 as a result of a standard alignment tolerance extreme. As a consequence, a portion of current, $I_2$, of the current, $I_{in}$, input to the heater resistor 309 ink ejector flows through the shorting bar portion 820 rather than out of the heater resistor segment 801 output port (as illustrated by current $I_1$). The path through shorting bar portion 820 not only may be a shorter path through conductive material (and therefore present less parasitic resistance) but, more detrimentally, will be a shorter path through the resistive material of heater resistor segment 801 (and heater resistor segment 803). The shorter heater resistor path also yields a lower resistance and therefore conducts more current.

Figure 8C:
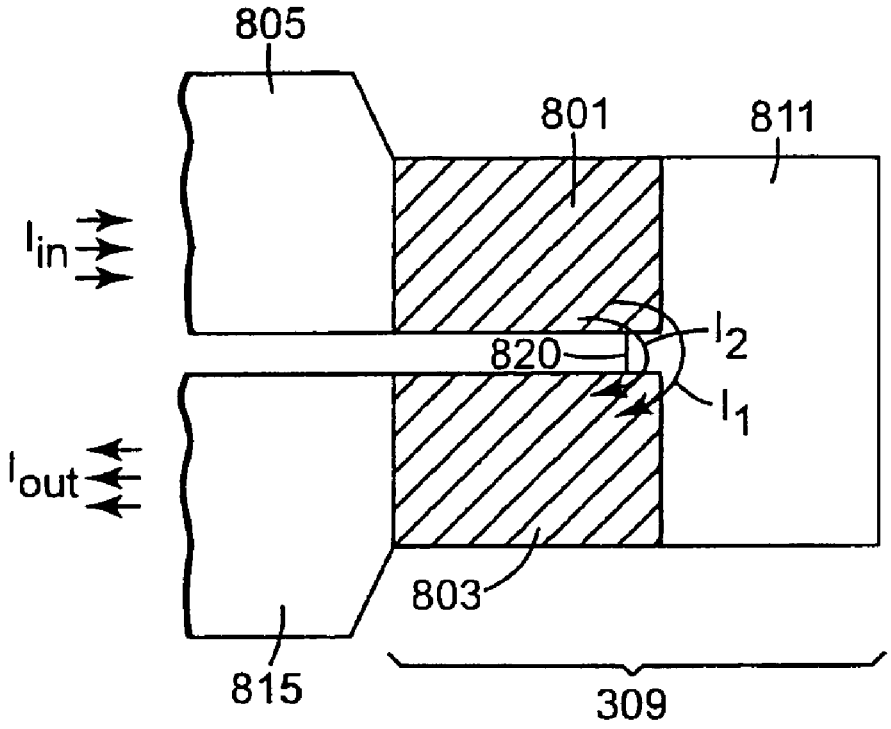
Figure 9:
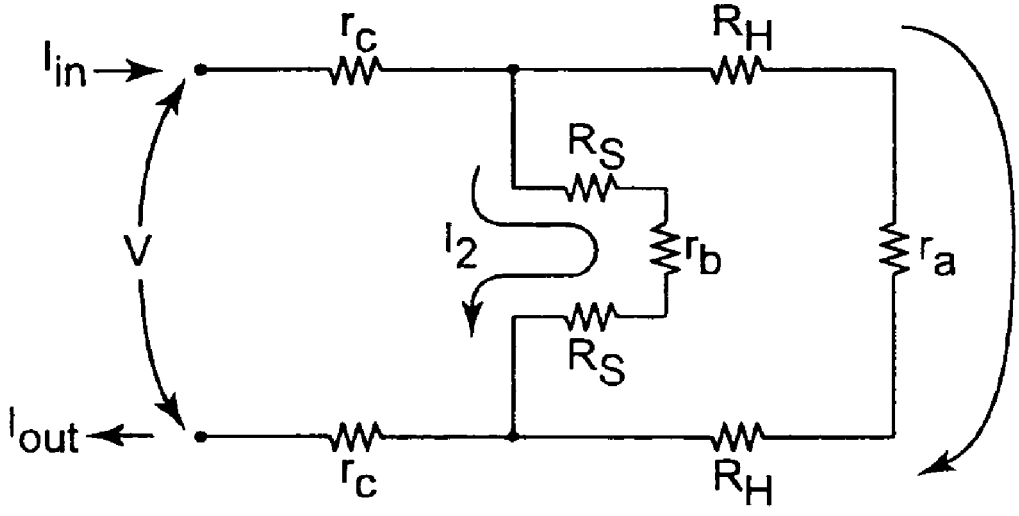
FIG. 9 is an electrical schematic diagram of the segmented heater of FIG. 8B.

Viewed another way, the schematic diagram of FIG. 9 represents the electrical model of the two selected currents of FIG. 8C. The input current $I_{in}$ experiences the parasitic resistance, $r_C$, of the conductor 805 before being applied to the heater resistor segment 801. The current path through the shorting bar portion 820 encounters the resistance of the short path through heater resistor segment 801, $R_S$, and heater resistor segment 803, $R_S$, as well as the short path shorting bar portion parasitic resistance, $r_b$, before the parasitic resistance, $r_C$, of conductor 815. The desired current, $I_1$, path through the heater resistor segments 801 and 803 encounters the desired resistance, $R_H$, of each heater resistor segment and the parasitic resistance, $r_a$, of the shorting bar conductor. (It is recognized that current through the shorting bar can and will take a multiplicity of paths through the shorting bar, and $I_1$ represents only one of such paths. The most likely path, the path of least parasitic resistance, is typically the shortest path between the output port of the heater resistor segment 801 and the input port of the heater resistor segment 803). Because of the shorter path through the heater resistor segments contacted by the shorting bar portion 820:

$$R_S<R_H,$$

and because of the likely shorter path through the shorting bar portion 820:

$$r_b \leqq r_a.$$

Since:

$$2R_S+r_b<2R_H+r_a,$$

for any given $I_{in}$:

$$I_2>I_1.$$

Thus the greatest current and the highest current crowding is expected to be through the shorting bar portion 820. The highest rate of failures will occur around the shorting bar portion 820 and the lifetime of the heater resistor will be unacceptably diminished.

In order to overcome this result, a cut or discontinuity is introduced into the shorting bar such that, under the processing variations of a controlled thin film production environment, a short path shorting bar portion (like portion 820) will not be created. Such a cut, notch 825, is illustrated in the long dimension of shorting bar 811 of FIG. 8A. In the preferred embodiment, this cut is created during the conventional metal conductor deposition, masking, and etching steps. As depicted in FIG. 8A, the conductive film 811 couples the resistors 801 and 803 in series by connecting together end portions of the segmented resistors 801 and 803. The notch 825 disrupts an otherwise (when viewed from above as in FIG. 8A) minimum length current pathway from the end portion of resistor 801 to the end portion of resistor 803 to reduce current crowding that would occur in the portion of the conductive film closest to and connecting to the end portions. In the preferred embodiment, this results in a generally U-shaped current flow path (when viewed from above as in FIG. 8A) from resistor 801, through the thin film conductor 811, and to resistor 803.

While a perfectly aligned, non-cut, shorting bar is deemed to be the optimum solution to coupling the two heater resistor segments, this solution cannot be reliably achieved in a real production environment. The cut in the shorting bar provides a high production yield solution. The minimum width of the shorting bar should be no less than 10 $\mu$m for thin film conductor deposition thicknesses of approximately 5000 Angstroms. The minimum width of the shorting bar varies in proportion with the deposition thickness.

In the preferred embodiment, where the resistance of each segmented heater resistor ink ejector is nominally 140Ω and the electrical power supply voltage is 10.8 Volts±1%, the plan view design dimensions of the heater resistors of FIG. 8A include a heater resistor segment length, $l_R$, of ranging between 20.5 $\mu$m and 24.0 $\mu$m and width, $w_R$, ranging between 9.0 $\mu$m and 11.0 $\mu$m. The shorting bar includes a length, $l_S$, of approximately 20.5 $\mu$m and a width, $w_S$, of approximately 20 $\mu$m. The design center value for the shorting bar cut is for a notch of depth, $d_c$, ranging between 2.2 $\mu$m and 4.2 $\mu$m and a notch width, $w_c$, ranging between 1.5 $\mu$m and 5.0 $\mu$m. The cut shape for the preferred embodiment was determined to be a rounded, or "U"-shaped, notch to avoid sharp discontinuities that would increase current crowding at points of small radius. Nevertheless, other cut shapes can be employed at the designer's choice, to obtain other performance advantages.

It is common to electrically arrange the many heater resistors disposed on the printhead substrate into groups generally called primitives. These primitives are individually supplied electrical current in sequence from the electrical power supply located in the printer. To complete the electrical circuit, a ground, or common, return conductor returns the electrical current to the power supply. In a preferred embodiment, each heater resistor within a primitive has its own associated switch circuit such as a field effect transistor. Each switch circuit is connected to an address pad that receives signals from the printer for activating the switch circuit into a conductive state to allow the heater resistor associated with the switch circuit to be fired. In this embodiment, each address pad is connected to the switch circuit of one resistor in each primitive. When the printhead is operated, the printer cycles through the addresses such that only a single heater resistor is energized at a time for a particular primitive. However, multiple primitives can be fired simultaneously. For maximum print densities, all of the primitives may be fired simultaneously (but with a single heater resistor energized at a time for each primitive). In one such embodiment, each address line is connected to all of the primitives on the printhead. In another embodiment, each address line is only connected to some of the primitives. In a preferred embodiment, each primitive is connected to a separate primitive select line that provides power for each primitive.

Each primitive select line has its own separate pad on the substrate for selective energization. Thus, the number of primitive select lines correspond to the number of primitives. When a particular heater resistor is energized the address associated with that resistor is activated to put the switch circuit associated with that particular resistor into a conducting condition that provides a low resistance path to current that would flow through the switch circuit and through the heater resistor. Then, while the switch is conducting, a high current firing pulse is applied to the primitive select line to energize the particular heater resistor. After firing, the address line is deactivated to place the switch circuit into a non-conducting state.

In previous printhead designs, a separate ground lead has been provided for each primitive. An aspect of this invention is that a single ground lead is connected to multiple primitives to reduce the number of required interconnections to the substrate. In one embodiment, at least four primitives are connected to the same ground lead. Each ground lead has at least one ground pad. When a particular heater resistor is fired, current travels from the primitive select pad, through the switch circuit and resistor, returning to the ground pad. However, if many Or all of the primitives are operated simultaneously, the parasitic power dissipation in a single ground lead can be large. To reduce this effect, the heater resistor value is increased from a conventional value of about 30 to 40 Ω to about 140 Ω measured between primitive select and ground pads.

To further reduce parasitic power dissipation, multiple ground pads are connected in common with the single ground lead to reduce the resistance between grounds and primitives. These leads are preferably spaced apart on the substrate to help balance the resistance of resistors located in the center of the die versus resistors more toward the edge of the die where the ground pads are typically located.

Figure 10:
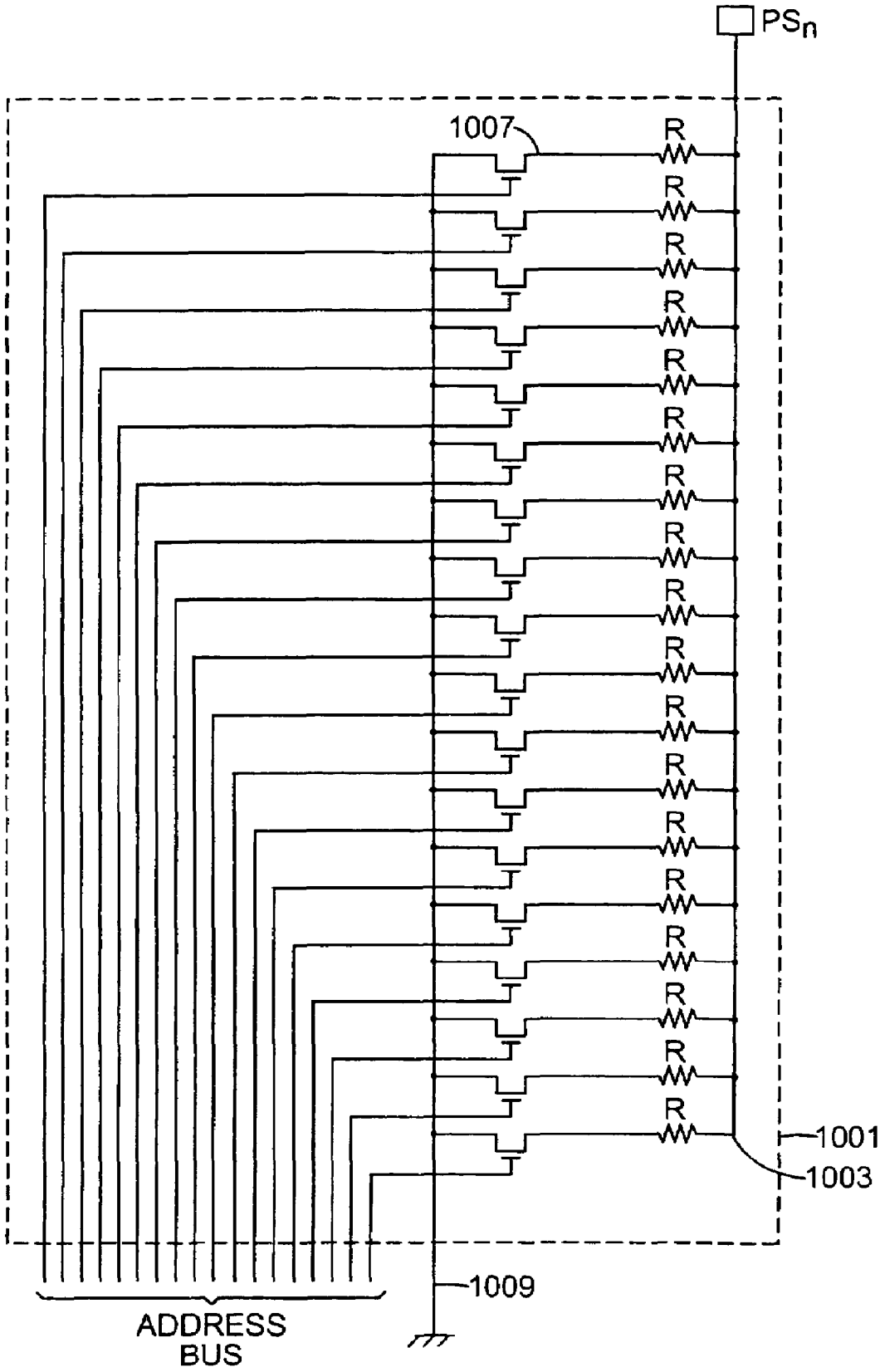
FIG. 10 is an electrical schematic of a printhead primitive which may be employed in the present invention.

In a preferred embodiment, a primitive consists of eighteen ink ejecting heater resistors. An electrical schematic of one primitive 1001 is shown in FIG. 10. Eighteen heater resistors, R, are each connected to a conductor 1003, which is a conductive metal film deposited on the substrate such as shown previously for FIG. 4. Conductor 1003 is physically routed away from the heater resistors and terminated in an interconnect terminal, PSn, that is conventionally interconnected with the flexible tape 117 for coupling to the power supply 217 of the printer. The heater resistors, R, are individually coupled to the drain terminal of a MOS transistor switch (for example, transistor 1007) as shown in FIG. 10. The source of the transistor switches of primitive 1001 are connected to the ground return conductor 1009. To activate (energize) a heater resistor, the associated transistor switch must be placed in a conducting mode. This is accomplished in a preferred embodiment by applying an activation signal to the signal line of the address bus associated with the heater resistor to be energized. The activation signal biases the gate terminal of the transistor switch to put the transistor in a conducting (on) condition. Each signal line of the address bus is sequentially activated for a period of time (for example, approximately 1.4$\mu$ sec in a preferred embodiment) in order to allow an ink vapor bubble to form and eject an ink drop from the nozzle associated with the energized heater resistor. Of course, if the character or image being printed does not require an ink dot at the present location of the medium and print cartridge, the activation signal to the heater resistor is suppressed by the printer drop firing controller 215.

In a preferred embodiment, eight primitives are arrayed on either side of an elongated opening, or slot (shown as slot 1101 in FIG. 11A) in the printhead substrate. This arrangement can be appreciated from the schematic plan view representation of the top surface of the printhead substrate shown in FIG. 11A. Not shown are the orifice plate and barrier layer, which would otherwise obscure the surface of the substrate. The elongated opening 1101 extends from the top surface of the substrate, upon which the heater resistors are deposited, to the bottom surface of the substrate, which is typically affixed to the body of the print cartridge and which is coupled to the supply of ink available to the print cartridge. Ink enters the printhead via the elongated opening and is distributed to each firing chamber.

Four primitives are disposed at one linear edge 1103 of the elongated opening 1101, for example primitives numbered 1, 3, 5, and 7, and having an electrical circuit 1001 like that shown in FIG. 10. Four other primitives, numbered 2, 4, 6, and 8, are disposed at the other linear edge 1105 of the elongated opening 1101. For clarity, individual heater resistors (for example, heater resistor 301, a member of primitive number 1) are illustrated arrayed around the elongated opening 1101 in the FIG. 11A view of the printhead substrate. Heater resistor members of primitive number 2 and a few of the theater resistors of primitives 3 and 4 are also shown.

Returning to FIG. 11A, it can be seen that the address bus 1107 with eighteen signal lines is electrically parallel coupled to each primitive so that each primitive is activated simultaneously with the sequenced activation signals applied to the address bus by the printer drop firing controller 215. The physical arrangement of the address bus conductors on the substrate are shown in generalized fashion; the actual physical orientation of the conductors may be varied as the layout requirements of the printhead demand. The primitive electrical current supply conductors (for example conductor 1109, coupled to primitive number 1, 1001, and input terminal PS1) are independently coupled to each primitive to couple high current electrical power from the printer power supply 217 (coupled via the flexible tape 117) to each of the primitives. Depending upon the print cartridge position relative to the medium upon which ink dots are to be deposited, the character or image to be printed, the particular color hue and intensity required, and the orientation of the particular drop generator (which will have a particular positional relationship to other drop generators), a range of no primitive to all primitives may have the high current electrical power supplied from the power supply.

The ground return conductor is coupled to all eight of the primitives and utilizes two widely spaced output terminals to complete the electrical circuit to the power supply. This ground-return conductor 1111 is coupled to each of the primitives, which are disposed four at one edge of the elongated opening 1101 and four at the other. Two terminals, G1 and G2, are located at opposite ends of the elongated opening, the ends being defined by the narrow end edges 1113 and 510 that join the long parallel edges 1103 and 1105. Thus, the surface perimeter edge of the elongated opening is defined by the two long parallel edges 1103 and 1105 and end edges 1113 and 510. Several advantages are gained by spacing the two return conductor terminals apart and at opposite ends of the elongated opening. Reducing the number of ground return conductors from one per primitive to an electrically shared pair for all primitives enables a closer spacing of drop ejectors ñ and higher DPI. Sharing the two terminals provides redundancy for the ground return for all primitives. Previously, the loss of a ground return terminal for a primitive would disable the entire primitive and practically make a print cartridge worthless; eighteen non-functioning drop ejectors yields a terrible quality of printed characters or images. A loss of one of the shared ground return terminals in a printhead employing the present invention does not disable an entire primitive.

Figure 11A:
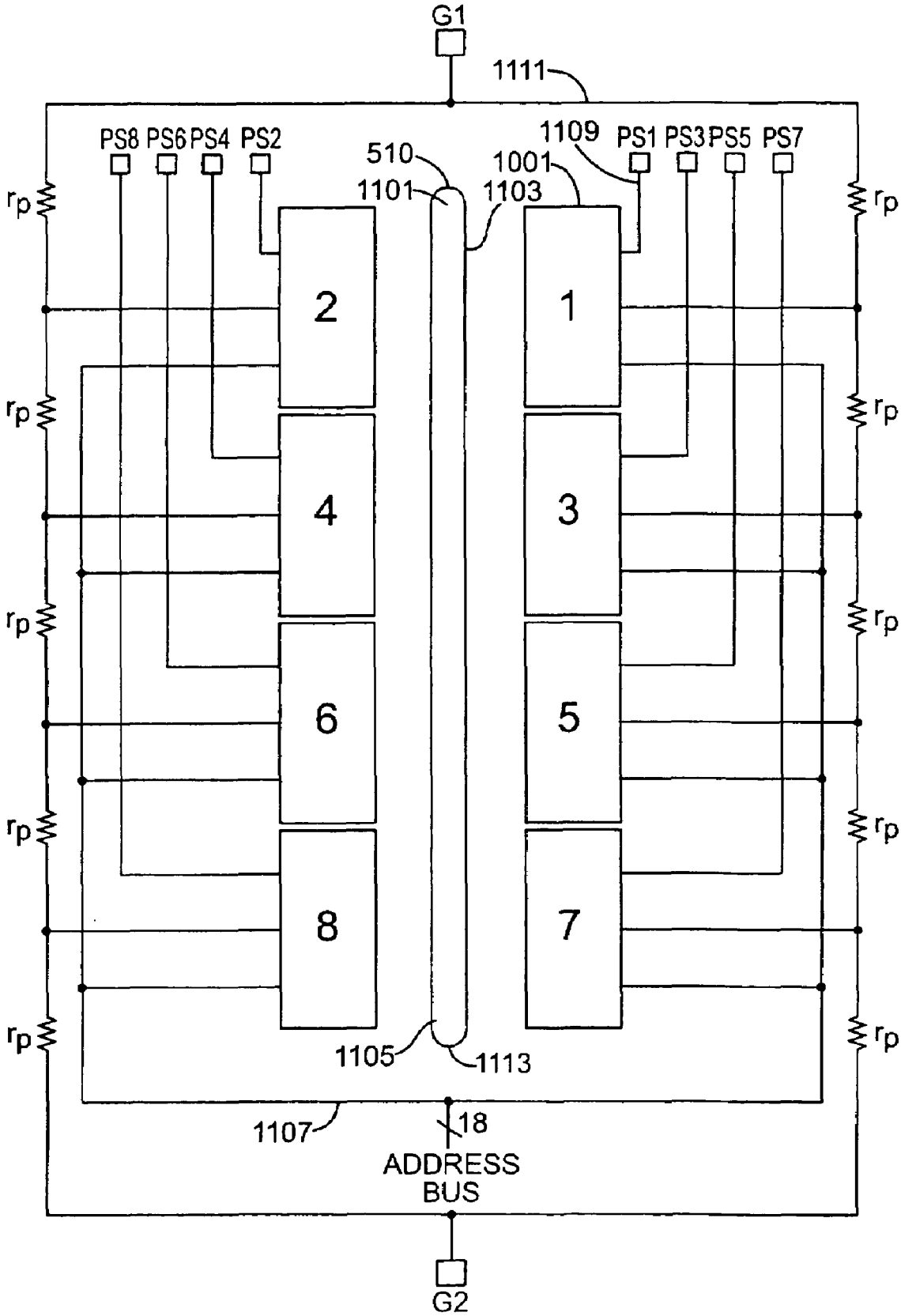
FIG. 11A is a plan view representation of an eight-primitive arrangement disposed on part of a printhead substrate.
Figure 11B:
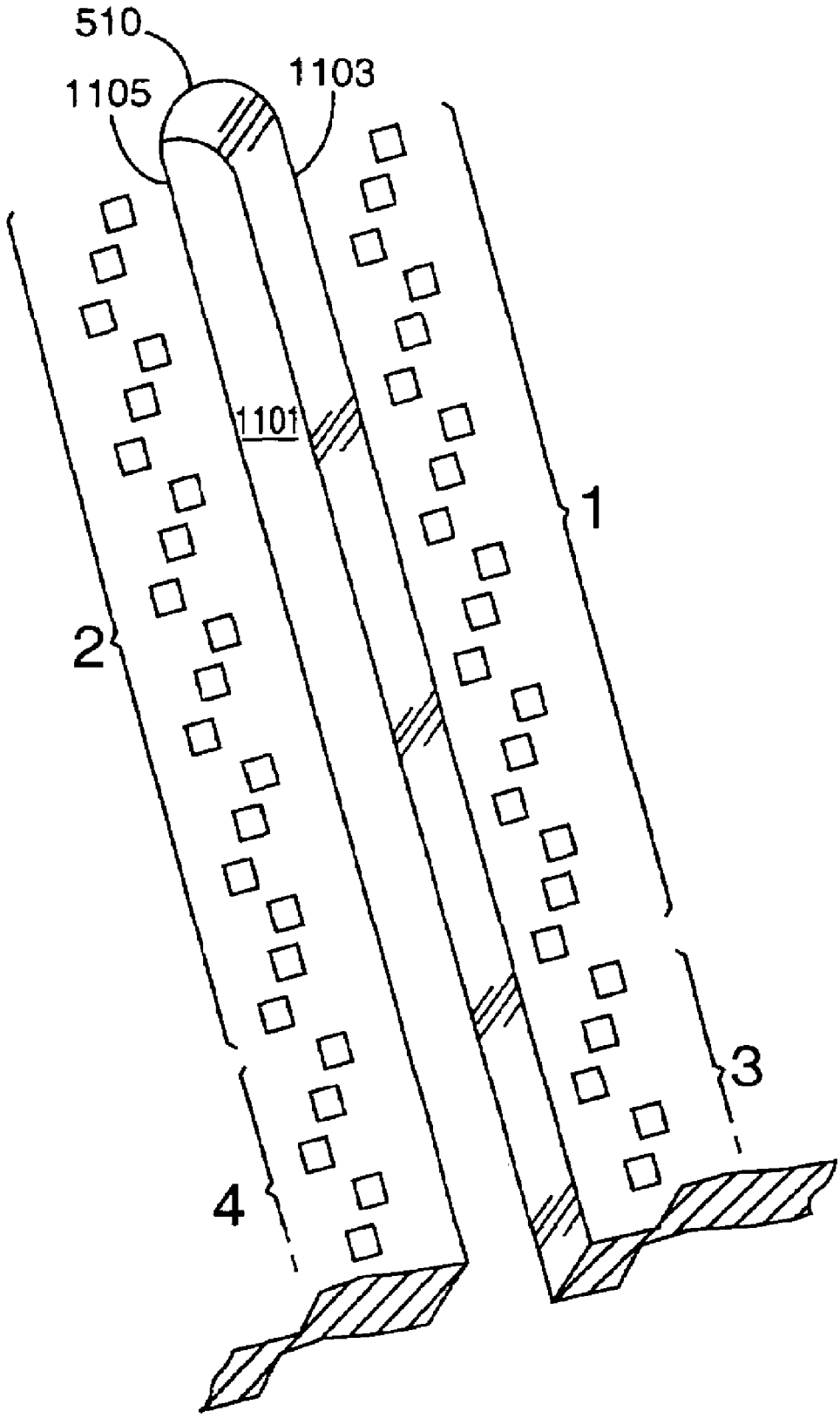
FIG. 11B is an enlarged isometric view of a printhead substrate illustrating some of the primitives of FIG. 11A.

A better balancing of parasitic resistances between primitives is also achieved when two ground return terminals are shared. The parasitic resistance in sections of the ground return conductor 1111 is schematically represented by $r_P$ and is physically manifested as the finite resistance in a conductive material that is not a perfect conductor. A shared ground return conductor can be idealized in sections as shown in FIG. 11A. Consider the ground return conductor parasitic resistance experienced by primitives 1, 2, 7, and 8:

$$R_{P1}=(4r_P^2)/(5r_P)=(4/5)r_P$$

Then consider the ground return conductor parasitic resistance experienced by primitives 3, 4, 5, and 6:

$$R_{P2}=(6r_P^2)/(5r_P)=(6/5)r_P.$$

Unless other measures were undertaken in previous implementations, the parasitic resistance variations in independent ground return conductors could experience resistance variations of as much as 4:1 in an eight primitive design. This variation can be contrasted to the more benign 2:3 variation found when employing the present invention. Of course, it should be recognized that the actual parasitic resistance are dependent upon substrate layout and other factors. Moreover, it is within the scope of the present invention that more than two ground return terminals may be shared by all the primitives. Furthermore, it is likely that more than eight primitives will be used for larger printhead applications.

Figure 12:
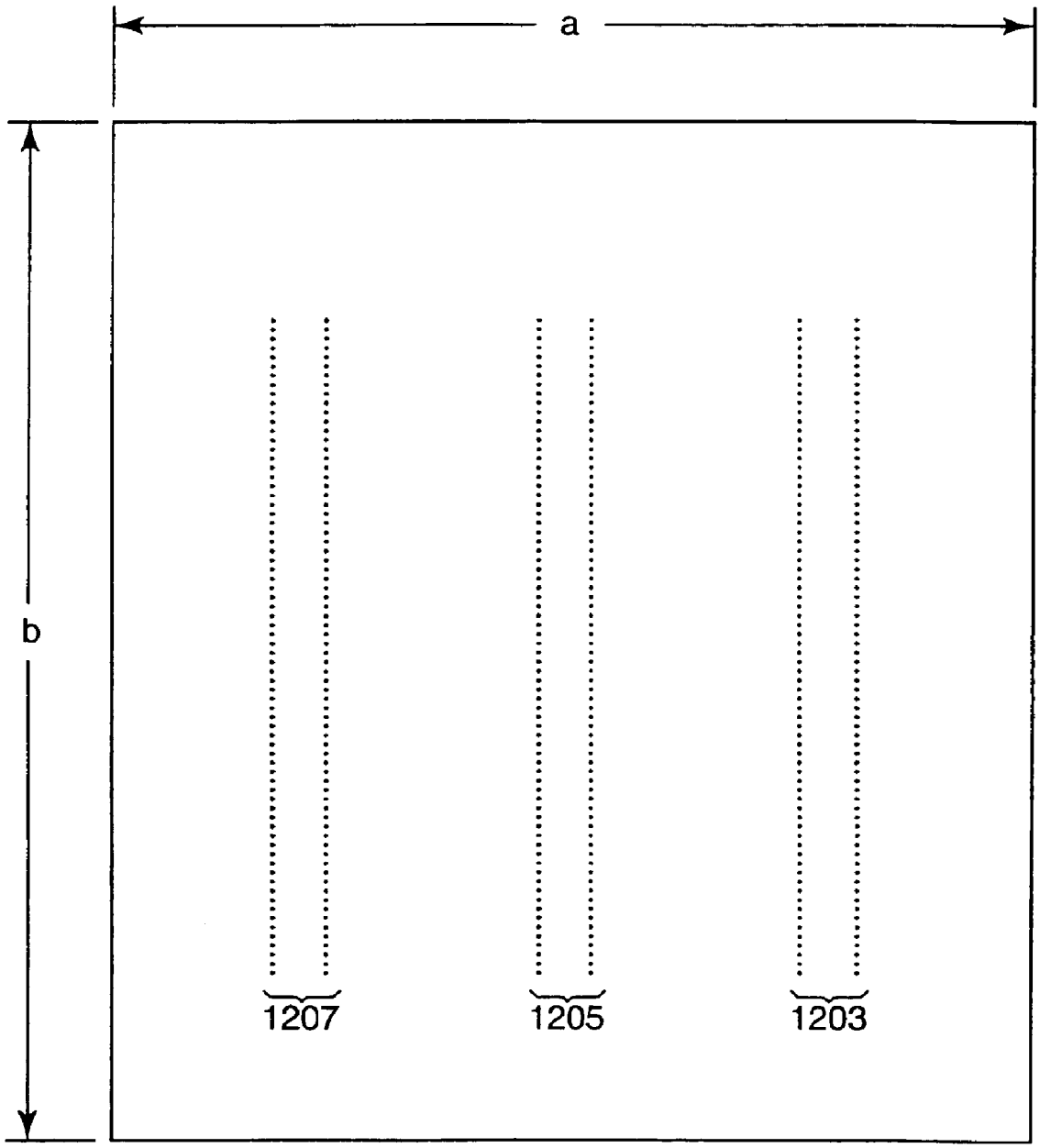
FIG. 12 is a plan view of the exterior surface of a printhead orifice plate which may employ the present invention.

In a three color (e.g., cyan, yellow, and magenta) print cartridge, three elongated openings are utilized to supply each of the three colors. Three independent sets of eight primitives each, one for each color, are arranged on the printhead. Each primitive, in a preferred embodiment, utilizes the primitive and elongated opening design described above. A preferred arrangement is illustrated in the plan view of the outer surface of an orifice plate of FIG. 12. A total of 432 drop generators are arranged on the printhead in three color groups of 144 drop generators each. The arrangement is such that 1200 DPI resolution in the scan direction, X is achieved. The dimensions of the semiconductor substrate to which the orifice plate is secured are shown as a width dimension, a, of nominally 7.9 mm (along the X, scan, direction) and a height dimension, b, of nominally 8.7 mm which is held within a 0.4% tolerance. The drop generator nozzles are shown in essentially parallel rows of 144 nozzles each: a yellow group 1207, a cyan group 1203, and a magenta group 1205. Within each color group, the heater resistors are organized into eight primitives. Considering one of the color groups, for example the yellow group, a magnified view of a portion of the heater resistor of this group with the orifice plate and firing chamber-defining barrier layer removed is illustrated in FIG. 9. In a preferred embodiment, the heater resistors (for example, heater resistor 912) are arranged on both long sides of an elongated ink supply slot 1101.

In an ink firing operation, the address bus lines are sequentially turned on via the electrical conductors of the flexible tape 117 or 119 according to the drop firing controller 215 located in the printer which sequences (independently of the data directing which resistor is to be energized) from an address bus line A1 to the last address bus line An when printing form left to fight and from An to A1 when printing from right to left. The print data retrieved from the memory within the drop firing controller 215 turns on any combination of the primitive select (PS) lines.

Figure 14:
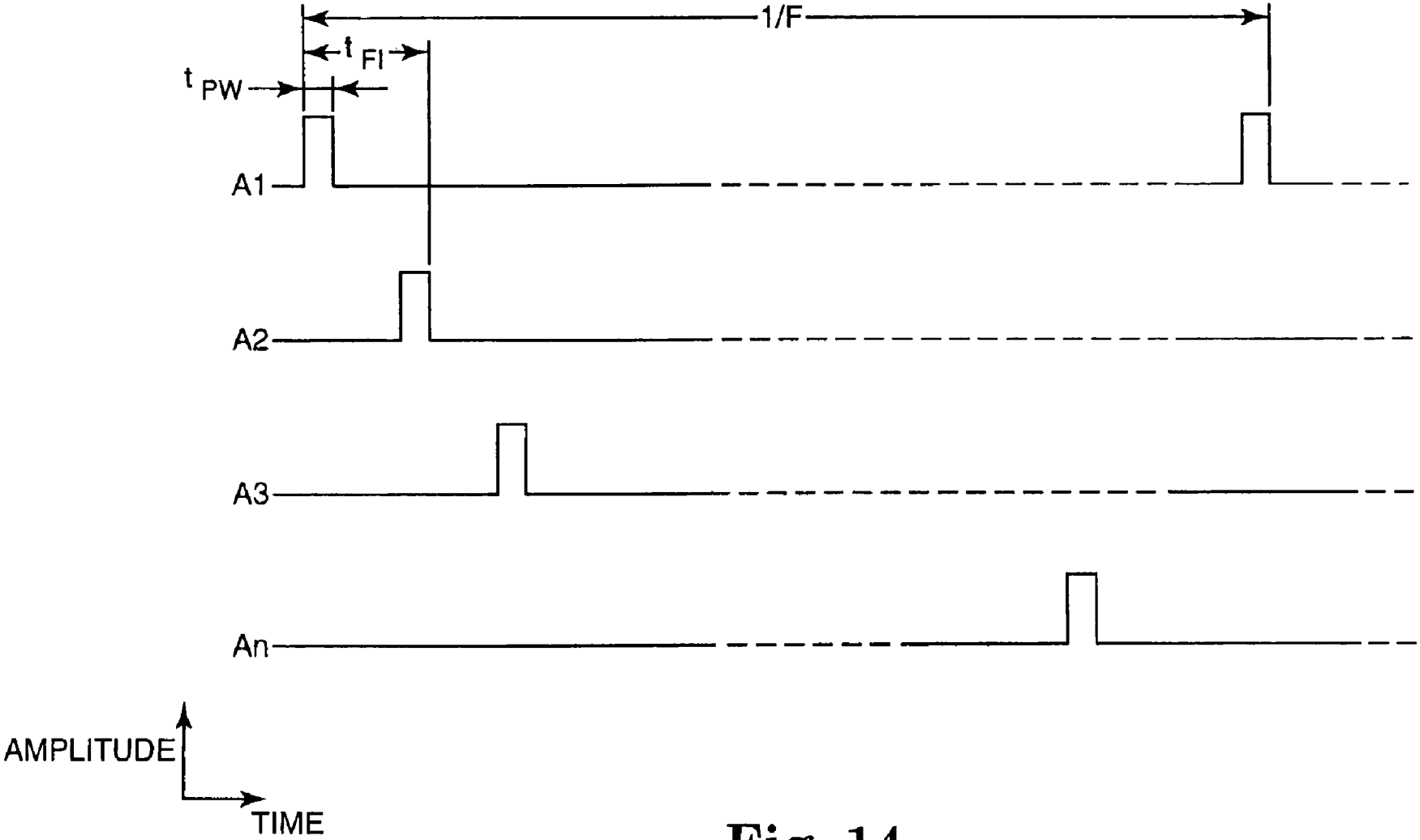
FIG. 14 is a timing diagram of heater resistor activation which may be employed in the present invention.

The firing signals applied to the address lines A1–An are shown in the timing diagram of FIG. 14. The amplitude of the address line signals is shown on the y axis and time is shown on the x axis. During one firing cycle (1/F) every address in each primitive is fired; thus, every heater resistor in every primitive can be energized once during a firing cycle. Each firing cycle is made up of a plurality of firing intervals ($t_{FI}$). The firing interval for a printhead in the preferred embodiment comprises several of the firing intervals for each heater resistor and consists of a pulse time ($t_{PW}$) plus a dead time. This pulse time is the amount of time that the energy exceeding the turn-on energy is applied to the selected heater resistor. In the preferred embodiment this pulse time is 1.4 $\mu$msec±0.1 $\mu$m sec. The remainder of time, the dead time, is the time interval from the end of one pulse on an address line (for example, A1) and the beginning of the next sequential pulse on the next address line (A2). The dead time length not only provides time for the print cartridge carriage 109 to move to the next firing position (if required) but, as a feature of the present invention, provides a cooling period during which no energy is applied to the printhead. Furthermore, each heater resistor is not always selected for printing; the selection occurs as a function of the character or image to be printed and is selected by the appropriate address and primitive lines being selected with regard to the particular position of the print cartridge relative to the medium. Thus, the power supply 217 is not always supplying power to the printhead.

In a preferred embodiment, an address line is turned on first then a primitive select line is turned on for the desired pulse time. In order that the print cartridge employing the present invention be able to rapidly deposit ink dots on the medium (particularly for small drops in the 5 ng weight range), the heater resistors must be energized at a high rate. Depending upon the mode of operation of the printing device using the print cartridge employing the present invention, the firing rate can be set in excess of 18 KHz (for a draft printing mode). Nominally, the firing rate is set at 15 KHz. When power is supplied to a selected heater resistor, it is limited by the value of the resistance of the heater resistor, the power supply voltage, and the pulse time duration. In a preferred embodiment, a firing pulse is in the range of 1.0 to 1.4$\mu$ Joules. In order to realize sufficient energy in the approximately 1.4 $\mu$sec pulse to exceed turn-on energy, the thickness of the passivation layer was reduced as described above. Such a thin silicon-based passivation layer had been subject to defects in the past but improved processing and beveling of the conductor layer 413 has enabled the thinner passivation layer to be used.

The substrate of the present invention is divided into various topographic regions that each contain at least one primitive. Within each region, the address lines are shared; each primitive has its own unique primitive select line. Alternate embodiments, however, can provide each region on the die with its own separate set of address lines.

Figure 13A:
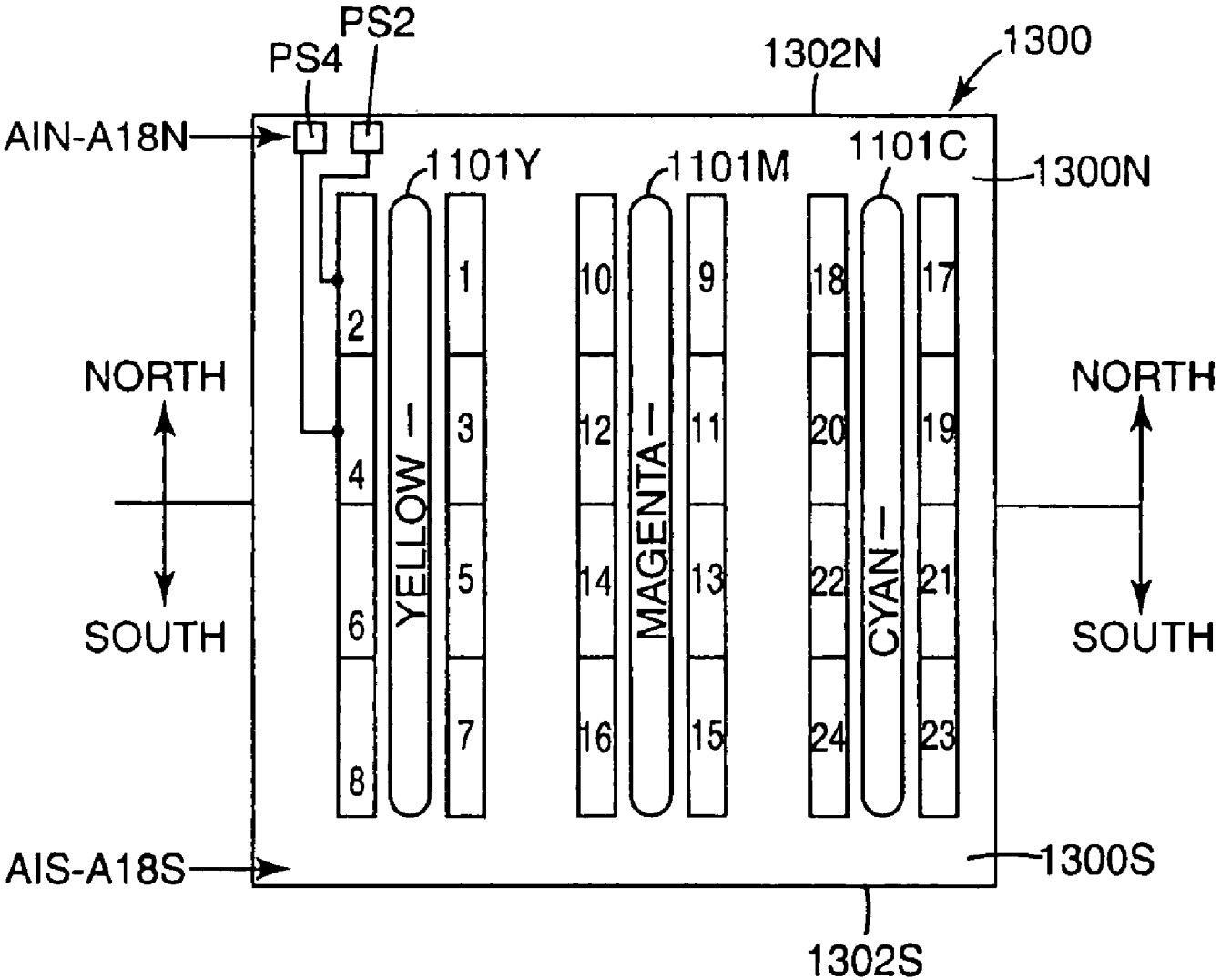
FIGS. 13A and 13B are plan views of a printhead illustrating north-south primitive arrangement.

A schematic diagram of a preferred embodiment of the present invention is illustrated in FIG. 13A. A substrate 1300 has three ink feed slots or ink apertures through which ink from an ink reservoir feeds to firing resistors adjacent to the feed slots. Alternate embodiments would include substrates providing only a single-color aperture or other colors as well. In a preferred embodiment there are three ink feed slots, one slot 1101Y providing yellow, one slot 1101M providing magenta, and one slot 1101C providing cyan ink to the resistors. The resistors are arranged into 24 primitives along the feed slots 1101, indicated in the figure by the number 1-24. For example, along the ink feed slot providing yellow ink, primitives 2, 4, 6, and 8 are arranged along one side of the feed slot, and primitives 1, 3, 5, and 7 are arranged along an opposing edge of the feed slot 1101Y.

In a preferred embodiment, each primitive includes 18 firing resistors (with each coupled to a separate current-controlling FET) with a single primitive select line shared between the 18 resistors within each primitive. Alternate embodiments would of course include larger as well as smaller numbers of firing resistors and transistors per primitive. Thus, for the substrate of the present invention, there are 24 independent primitive select lines PS1 to PS24 (only PS4 and PS2 shown) corresponding to the 24 primitives.

Each primitive select line routes to a connector pad located along one of two outer edges 1302N or 1302S of the substrate. In order for each resistor within a particular primitive to be separately energized, each resistor is connected to a current-controlling transistor, each having a separate address line (not shown).

Figure 13B:
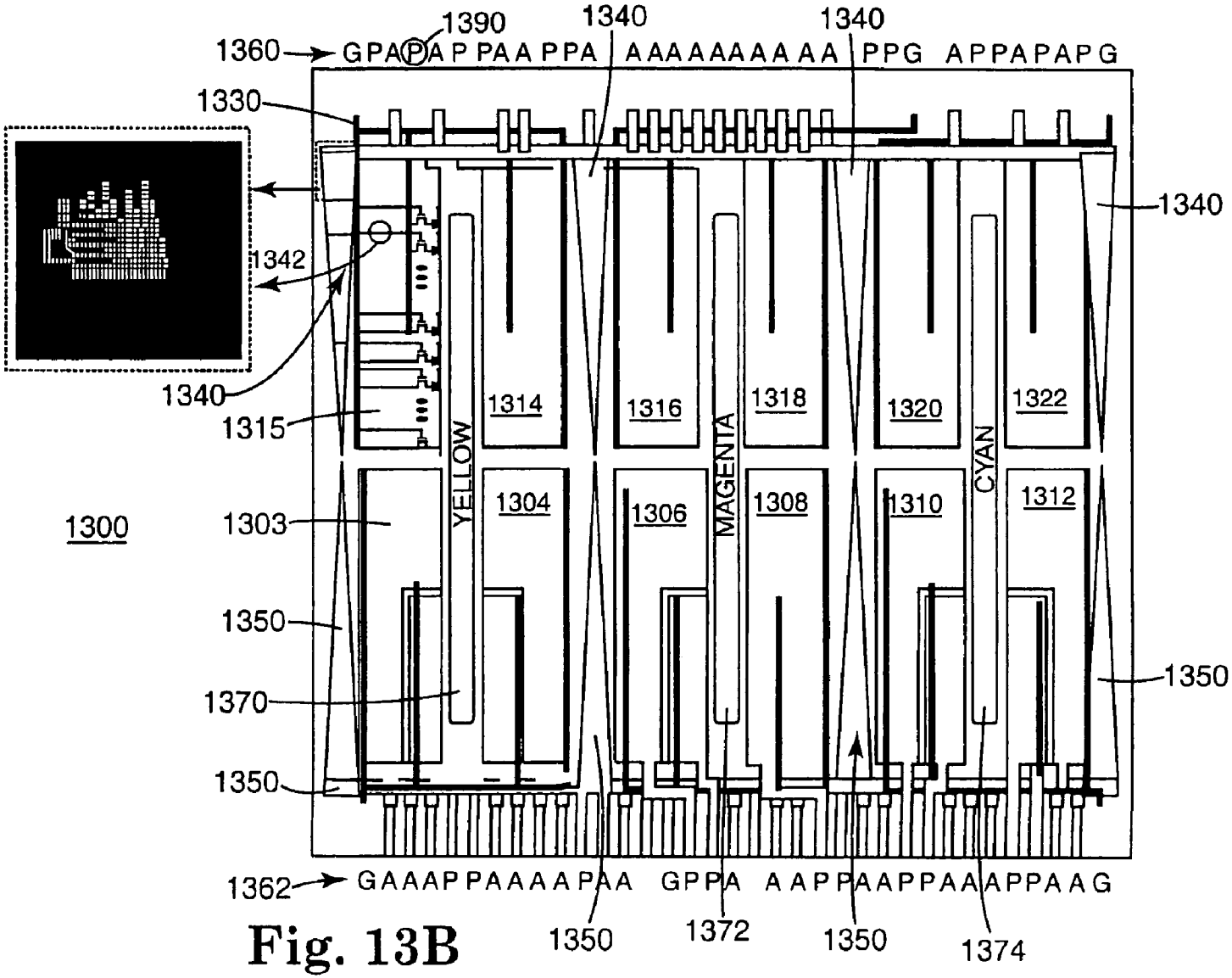

During a printing operation, the printer cycles through the addresses as depicted in FIG. 13B such that only a single one of the 18 firing resistors within a particular primitive is operated at a time, i.e. sequentially. However, resistors in different primitives may be operated simultaneously. For this reason, and to minimize a number of contacts required, primitives share address lines. Thus, for a given set of primitives sharing address lines, there are 18 address lines to allow for independent operation of addresses for a particular primitive.

To improve reliability and to allow multiple modes of operation, the primitives of the substrate are segregated into groups. One group of primitives is addressed by a first set of address lines for the primitives in the group. A second group of primitives is addressed by a separate set of address lines for the second group. The two groups of primitives are divided into regions that are designated as north 1300N and south 1300S for purposes of identification. In this example, half of the primitives are contained in region 1300N closest to substrate edge 1302N. The other half of the primitives are contained in region 1300S closest to the substrate edge 1302S. Alternate embodiments include dividing the primitives in uneven groups spread across the substrate in any ratio.

One set of 18 address select lines, referred to as A1N, A2N, . . . , A18N, provide address select signals to the switching devices in the region 1300N. Another set of 18 address select lines, referred to as A1S, A2S, . . . , A18S provide address select signals to the switching devices in the region 1302S.

Providing separate north and south (or upper and lower) address leads to the transistors in the primitives in the north and south regions provides several benefits. First, the susceptibility to losing an address connection is reduced by one half. Second, by having independent sets of address leads for the separate groups of primitives, multiple firing modes are enabled for the same printhead. As discussed before, printheads are operated by cycling through address lines. By having north and south primitives, the printhead can be operated as having either 24 or having 12 primitives.

Address pairs of the north and south groups can be electrically or functionally "tied" together by appropriate circuitry so that combinations of transistors in any combination of groups can be fired together. In one such embodiment, each time a particular north address is activated (for example, A1N), the corresponding south address is simultaneously activated (for example, A1S). This can be done by making A1N electrically common with A1S, A2N electrically common with A2S, etc. using any appropriate circuitry. This allows for higher speed or higher frequency printing, because it takes less time to cycle through the addresses.

On the other band, the printhead can also be operated as having 12 primitives. This can be done by serially cycling through all of the south addresses and then all of the north addresses. Although slower, this provides the opportunity to make pairs of primitive select lines electrically common but keeping the address lines electrically isolated. This reduces the cost of the switching electronics required to energize the primitives, reducing the cost of the printing system.

In a printhead "primitive", which is a group of FETs coupled to a primitive select (PS)(lead) through separate heater resistors on the substrate, all of the FETs have power applied to them simultaneously. The FETs in the group are all connected to the common ground but each of the FETs in the group has its gate coupled to an address line. Individual FETs in a primitive can be fired separately if the FETs' primitive select lead and gate are active at the same time. Accordingly, a combination of a primitive select lead and an address select lead (gate) individually control each FET in a matrix fashion.

An inkjet printhead can be made more reliable when the several primitives on an inkjet printhead substrate (which surround or are proximate to an ink aperture) are organized into groups or clusters and when these groups of primitives are addressed by electrically separate address and primitive control lines. It is a feature of the present invention that the primitives on a substrate are divided along a line transverse to the ink aperture and that primitives on one side of this line are addressed by one address bus while primitives on the other side are addressed by a different address bus. A fault on one address bus will therefore not affect primitives controlled by the other address bus.

Considering now the detailed primitive layout of FIG. 13B, a schematic plan view of a surface of a three color printhead substrate is shown. In operation, yellow, magenta, and cyan inks would flow out of the plane of the figure, through the ink apertures 1370, 1372, and 1374 into firing chambers defined primarily by the barrier layer (not shown in FIG. 13B), and distributed along both sides of the ink apertures 1370, 1372, and 1374. The rectangular areas on opposite sides of the ink apertures (1303, 1304, 1306, 1308, 1310, 1312, 1314, 1315, 1316, 1318, 1320, and 1322) denote the primitives. It can be seen that the ink aperture 1370 has four primitives, 1303, 1304, 1315, and 1316, that are located about the ink aperture 1370. One primitive, 1315, schematically depicts the FET switches and heater resistors connected to them, proximate to one end adjacent to one side of the ink aperture 1370.

Each of the FETs of this primitive 1315 is coupled to a ground bus 1330 represented by the heavy line that can be seen on each of the primitive areas (1303, 1304, 1306, 1308, 1310, 1312, 1314, 1315, 1316, 1318, 1320, and 1322).

A first address bus 1340 is comprised of several conductors (individual conductors not shown), at least of which is extended to each gate of each FET in the first set of primitives (1314, 1315, 1316, 1318, 1320, and 1322) in the top portion of the substrate 1300 shown in FIG. 13B. A second address bus 1350 is comprised of several conductors (individual conductors not shown) at least one of which is extended to each gate of each FET in the primitives (1303, 1304, 1306, 1308, 1310, and 1312) of a second set of primitives along the lower portion of the substrate 1300 shown in FIG. 13B. The first and second address busses 1340 and 1350 are electrically isolated from each other but are accessible from the connectors 1360 and 1362 on the edges of the substrate 1300.

In a preferred embodiment, each FET of a primitive has its gate terminal coupled to an address line 1342. There are, therefore, a number of address lines "N" in an address bus 1340, 1350 that are equal to the number of drop generators (and FETs) in each of the primitives (1303, 1304, 1306, 1308, 1310, 1312, 1314, 1315, 1316, 1318, 1320, and 1322). The address lines to the gates of the FETs of one set of primitives (1303, 1304, 1306, 1308, 1310, 1312) are electrically isolated from the gates of the FETs of the other sets of primitives (1314, 1315, 1316, 1318, 1320, 1322). (In an alternative embodiment, the two sets of address lines may be indirectly or directly coupled together). The FETs in any set of primitives will not fire if those FETs are deactivated by their corresponding primitive control lines, depicted in FIG. 13B as the "P" lines 1390. The address lines are therefore effectively multiplexed to reduce the number of address lines needed to control numerous transistors in several primitives while allowing for individual selectability (addressability) of the drop generators. The only exception to this would be if one or more truncated primitives P (with less than N drop generators) is utilized. During a printing operation, the printing system cycles through the address lines such that only one of the address lines A1 through $A_n$ is activated at a time. Thus, within a primitive, only one drop generator can be activated at a time. However, all of the drop generators in the various primitives associated with a particular address can be fired simultaneously.

Figure 11C:
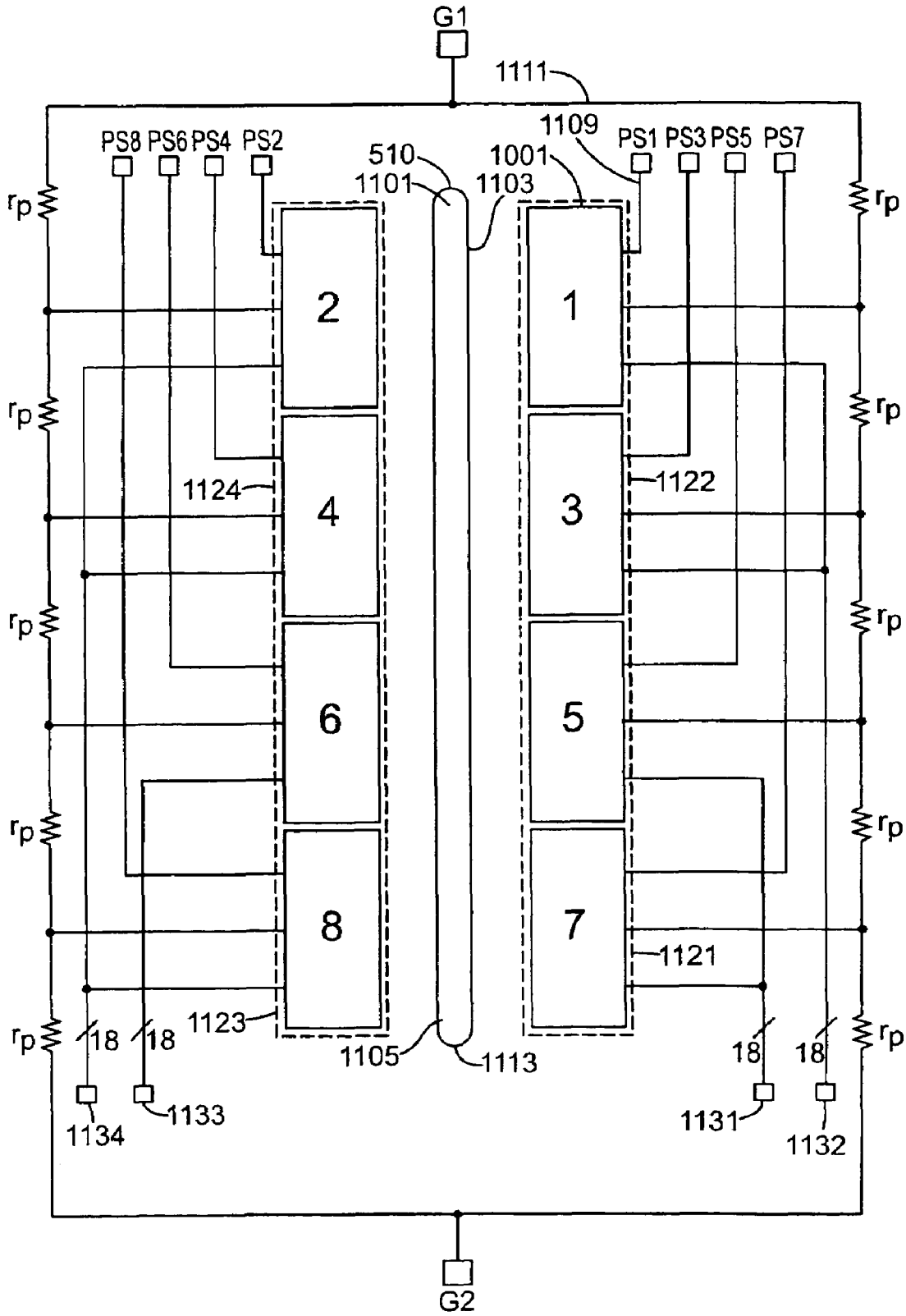
FIG. 11C is a plan view representation of an eight primitive arrangement disposed in north-south groups on part of a printhead substrate.

The primitives adjacent an ink supply slot 1101 can be themselves grouped into regions, for example four regions as shown in FIG. 11C, as regions 1121, 1122, 1123, and 1124. Alternative embodiments of the invention would include division into more or fewer than four regions per ink slot.

Referring to FIG. 11C, each of the regions has its own set of separate address lines that control the firing of FETs in the corresponding region and which are preferably electrically isolated from each other so as to avoid a fault on one line affecting all of the primitives to which it is connected. Thus, region 1121 has a first set of address lines A1, A2, . . . , $A_n$, terminating on the substrate in a set of address pads shown as a single terminal 1131 (for clarity). Region 1122 has a second set of address lines A1', A2', . . . , $A_n$' separate from the first set and terminating in a separate set of address pads illustrated as terminal 1132. Similar connection is illustrated for terminals 1133 and 1134.

In a first embodiment, the terminal 1131 represents flexible circuit connections that connect to electronics in the printer assembly when the printhead assembly is installed into the printing device. Alternatively, in a second embodiment, the terminal 1132 represents the bond pads on the semiconductor substrate. Intermediary circuitry such as a flexible circuit can be used to connect the bond pads to circuitry in the printing device. One method for connection to such bond pads is known in the art as TAB bonding, or tape automated bonding.

In a third embodiment, the number of address lines A1, A2, . . . , $A_n$ in region 1121 is equal to the number of address leads A1', A2', . . . , $A_n$' in region 1132 (although alternate embodiments would include using different numbers of address lines in each region). In the third embodiment, jumpers or conductive traces on the printhead or a flexible circuit attached to the printhead electrically connect the address line A1 to the address line A1', address line A2 to address line A2', . . . , address line $A_n$', etc. Thus, whenever address A is activated in region 1121, a corresponding address A' is activated in region 1132. By providing these separate connections for each address pair A and A', the crucial address connections are maintained even if a connection to one of them is lost. This assures that the proper signals are provided to the printhead even if one of the address connections to the printhead is lost.

In a fourth embodiment, the addresses in the regions 1121 and 1122 are electrically isolated. This allows the printing device to operate the printhead in two modes. The printer can activate pairs of address lines A and A'; simultaneously, allowing for a higher printing speed. One way to realize this is to include having the printing device circuitry electrically couple the address lines in pairs. Alternatively, the printer can operate the address lines A and A' independently while combining primitives between region 1121 and 1122 in pairs. This lowers printing device cost, but sacrifices speed.

Accordingly, a printhead employing a segmented heater resistor arrangement to obtain a higher heater resistance, a thinner passivation layer, and a lower heater resistor activation energy enables a compact printhead with high density drop generators and high printing throughput without excessive heat generation within the printhead to be realized.

We claim:

1. A fluid ejection device, comprising:

a substrate;

a plurality of resistors formed on the substrate;

a plurality of switches formed on the substrate, each of the plurality of switches coupled one of the plurality of resistors;

a plurality of conductors configured to provide energy to the resistors, wherein each conductor of the plurality of conductors is coupled to a different group of resistors of the plurality of resistors so that each resistor is coupled to only one of the plurality of conductors;

a ground conductor coupled to each of the different groups of resistors, so that each resistor of the plurality of resistors is coupled to the ground conductor;

a first ground pad coupled to the ground conductor and capable of being coupled with a contact external to the fluid ejection device; and a second ground pad coupled to the ground conductor and capable of being coupled with a contact external to the fluid ejection device, wherein a signal provided on the ground conductor is applied at both of the first ground pad and the second ground pad.

2. The fluid ejection device of claim 1, further comprising a plurality of address leads, each address lead coupled to one switch in each of the different groups of resistors and wherein a resistor does not conduct, when a signal is provided on the conductor of the plurality of conductors that it is coupled to a group of the plurality of groups if no signal is provided on an associated address lead for that resistor.

3. The fluid ejection device of claim 1, wherein each of the plurality of resistors has a resistance of at least 70 Ohms.

4. The fluid ejection device of claim 1, wherein a number of the different groups is at least four.

5. The fluid ejection device of claim 1, wherein each of the plurality of resistors has a resistance in a range of approximately 100 to 140 Ohms.

6. The fluid ejection device of claim 1, wherein the plurality of resistors are formed so that there are at least six resistors per square millimeter of portions of the substrate upon which the plurality of resistors are formed.

7. The fluid ejection device of claim 1, wherein the first ground pad and the second ground pad are positioned on opposite edges of the substrate.

8. The fluid ejection device of claim 1, wherein each resistor includes two resistor segments connected in series.

9. The fluid ejection device of claim 1, wherein a number of the plurality of resistors is at least 400.

10. A fluid ejection device comprising:

a substrate;

a plurality of resistors formed on the substrate;

a plurality of switches formed on the substrate, each of plurality of switches coupled to one of the plurality of resistors;

a plurality of conductors configured to provide energy to the resistors, wherein each conductor of the plurality of conductors is coupled to a different group of resistors of the plurality of resistors so that each resistor is coupled to only one of the plurality of conductors;

a ground conductor coupled to each of the different groups of resistors, so that each resistor of the plurality of resistors is coupled to the ground conductor;

a plurality of address leads, each address lead coupled to one switch in each of the different groups of resistors and wherein a resistor does not conduct when a signal is provided on the conductor of the plurality of conductors that it is coupled to a group of the plurality of resistors if no signal is provided on an associated address lead for that resistor;

a first plurality of address contacts formed on a first edge of the substrate the first plurality of address coupled to some of the address leads; and a second plurality of address contacts formed on a second edge of the substrate different than the first edge, wherein those address leads not coupled to the first plurality of address contacts are coupled with the second plurality of address leads.

11. The fluid ejection device of claim 10 further comprising:

a first ground pad coupled to the ground conductor and capable of being coupled with a contact external to the fluid ejection device; and a second ground pad coupled to the ground conductor and capable of being coupled with a contact external to the fluid ejection device, wherein a signal provided on the ground conductor is applied at both of the first ground pad and the second ground pad.

12. The fluid ejection device of claim 10 wherein the first ground pad is formed on the first edge and the second ground pad is formed on the second edge.

13. The fluid ejection device of claim 10, wherein each of the plurality of resistors has a resistance of at least 70 Ohms.

14. The fluid ejection device of claim 10, wherein each of the plurality of resistors has a resistance in a range of approximately 100 to 140 Ohms.

15. The fluid ejection device of claim 10, wherein the plurality of resistors are formed so that there are at least six resistors per square millimeter of portions of the substrate upon which the plurality of resistors are formed.

16. The fluid ejection device of claim 10, wherein a number of the different groups is at least four.

17. The fluid ejection device of claim 10, wherein a number of the plurality of resistors is at least 400.

18. A printhead comprising:

a substrate;

a plurality of resistors formed on the substrate;

a plurality of switches formed on the substrate, each of plurality of switches coupled to at least one of the plurality of resistors;

a plurality of conductors configured to provide energy to the resistors, wherein each conductor of the plurality of conductors is coupled to a different group of resistors of the plurality of resistors so that each resistor is coupled to only one of the plurality of conductors; and means for providing at least two ground paths from each resistor of the plurality.

19. The printhead of claim 18, wherein the two pads are positioned on opposite edges of the substrate.

20. The printhead of claim 18, further comprising means for providing signals to the switches so that only one resistor in each of the different groups of resistors conducts at a given time.

21. The fluid ejection device of claim 18, wherein each of the plurality of resistors has a resistance of at least 70 Ohms.

22. The fluid ejection device of claim 18, wherein the plurality of resistors are formed so that there are at least six resistors per square millimeter of portions of the substrate upon which the plurality of resistors are formed.

23. A fluid ejection device, comprising:

a substrate;

a plurality of switches formed on the substrate;

a plurality of primitives fanned on the substrate, each primitive including a plurality of resistors, each of the plurality of resistors coupled to a different switch of the plurality of switch circuits;

a plurality of primitive leads, each of the plurality of primitive leads is separately coupled to one of the plurality of primitives; and a plurality of address select leads, each address select lead coupled to one of the plurality of switches of each of the plurality of primitives, wherein a resistor does not conduct when a signal is provided on a primitive lead of the plurality of conductors that it is coupled to the resistor if no signal is provided on an associated address select lead;

a ground conductor coupled to each of the plurality of primitives, so that each resistor of the plurality of resistors is coupled to the ground conductor;

a first ground pad coupled to the ground conductor and capable of being coupled with a contact external to the fluid ejection device; and a second ground pad coupled to the ground conductor and capable of being coupled with a contact external to the fluid ejection device, wherein a signal provided on the ground conductor is applied at both of the first ground pad and the second ground pad.

24. The fluid ejection device of claim 23, wherein each of the plurality of resistors has a resistance of at least 70 Ohms.

25. The fluid ejection device of claim 23, wherein a number of primitives is at least four.

26. The fluid ejection device of claim 23, wherein each of the plurality of resistors has a resistance in a range of approximately 100 to 140 Ohms.

27. The fluid ejection device of claim 23, wherein the plurality of resistors are formed so that there are at least six resistors per square millimeter of portions of the substrate upon which the plurality of resistors are formed.

28. The fluid ejection device of claim 23, wherein the first ground pad and the second ground pad are positioned on opposite edges of the substrate.

29. The fluid ejection device of claim 23, wherein a number of the plurality of resistors is at least 400.

30. A fluid ejection device, comprising:

a substrate;

a plurality of resistors formed on the substrate;

a plurality of switches formed on the substrate, each of the plurality of switches coupled one of the plurality of resistors;

a plurality of conductors configured to provide energy to the resistors, wherein each conductor of the plurality of conductors is coupled to a different group of resistors of the plurality of resistors so that each resistor is coupled to only one of the plurality of conductors;

a ground conductor coupled to each of the different groups of resistors, so that each resistor of the plurality of resistors is coupled to the ground conductor and the ground conductor provides at least two paths to ground to each resistor.

31. The fluid ejection device of claim 30, further comprising a plurality of address leads, each address lead coupled to one switch in each of the different groups of resistors and wherein a resistor does not conduct, when a signal is provided on the conductor of the plurality of conductors that it is coupled to a group of the plurality of groups if no signal is provided on an associated address lead for that resistor.

32. The fluid ejection device of claim 30, wherein each of the plurality of resistors has a resistance of at least 70 Ohms.

33. The fluid ejection device of claim 30, wherein a number of the different groups is at least four.

34. The fluid ejection device of claim 30, wherein each of the plurality of resistors has a resistance in a range of approximately 100 to 140 Ohms.

35. The fluid ejection device of claim 30, wherein the plurality of resistors are formed so that there are at least six resistors per square millimeter of portions of the substrate upon which the plurality of resistors are formed.

36. The fluid ejection device of claim 30, wherein the two paths to ground are formed on opposite edges of the substrate.

37. The fluid ejection device of claim 30, wherein a number of the plurality of resistors is at least 400.

* * * * *

UNITED STATES PATENT AND TRADEMARK OFFICE

CERTIFICATE OF CORRECTION

PATENT NO. : 7,004,556 B2
APPLICATION NO. : 10/952155
DATED : February 28, 2006
INVENTOR(S) : Todd A. Cleland et al.

It is certified that error appears in the above-identified patent and that said Letters Patent is hereby corrected as shown below:

Title page, Item (75), "Inventors", delete "Storrs Hoen" and insert -- Storrs T. Hoen --, therefor.

In column 4, line 30, delete "fi" and insert -- ñ --, therefor.

In column 4, line 67, delete "beater" and insert -- heater --, therefor.

In column 7, line 59, delete "filing" and insert -- firing --, therefor.

In column 9, line 32, delete "boles" and insert -- holes --, therefor.

In column 9, line 40, delete "beater" and insert -- heater --, therefor.

In column 12, line 15, delete "mussing" and insert -- missing --, therefor.

In column 12, line 35, delete "µn" and insert -- µm --, therefor.

In column 17, line 55, delete "theater" and insert -- heater --, therefor.

In column 21, line 35, delete "band" and insert -- hand --, therefor.

Signed and Sealed this

Twelfth Day of May, 2009

John Doll

JOHN DOLL
*Acting Director of the United States Patent and Trademark Office*